US011825993B2

(12) United States Patent
Robertson et al.

(10) Patent No.: US 11,825,993 B2
(45) Date of Patent: Nov. 28, 2023

(54) SPINDLE AND COVER COMPONENTS FOR SHEET PRODUCT DISPENSERS AND DISPENSER SYSTEMS INCLUDING SUCH COMPONENTS

(71) Applicant: GPCP IP Holdings LLC, Atlanta, GA (US)

(72) Inventors: Timothy Robertson, Appleton, WI (US); Aaron Sinclair, Tyrone, GA (US); Steven Mattheeussen, Fremont, WI (US); Todd Schuelke, Hortonville, WI (US); Samuel Bruenger, Kaukauna, WI (US); John Grosz, Ripon, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 679 days.

(21) Appl. No.: 16/506,814

(22) Filed: Jul. 9, 2019

(65) Prior Publication Data

US 2020/0008630 A1 Jan. 9, 2020

Related U.S. Application Data

(60) Provisional application No. 62/695,592, filed on Jul. 9, 2018.

(51) Int. Cl.
*A47K 10/38* (2006.01)
*B65H 19/10* (2006.01)
(Continued)

(52) U.S. Cl.
CPC ..... *A47K 10/38* (2013.01); *A47K 10/3827* (2013.01); *A47K 10/40* (2013.01);
(Continued)

(58) Field of Classification Search
CPC ..... A47K 2010/3206; A47K 10/40; A47K 10/38; A47K 10/3836; B65H 19/10;
(Continued)

(56) References Cited

U.S. PATENT DOCUMENTS 676,335 A 6/1901 Moffatt
805,011 A 11/1905 Gomber
(Continued)

FOREIGN PATENT DOCUMENTS

CA 1072504 A 2/1980
CA 2130524 A1 2/1996
(Continued)

OTHER PUBLICATIONS

GP Compact Black Side-by-Side Double Roll Toilet Paper Dispenser (3 pgs.) Website visited Feb. 25, 2019 https://catalog.gppro.com/CATALOG/6281/29381?FILTER=full.
(Continued)

*Primary Examiner* — Minh Truong
*Assistant Examiner* — Raveen J Dias

(57) ABSTRACT

Spindles and cover assemblies for dispensing sheet product for use with coreless sheet product rolls. The spindle may include a hollow cylindrical body, which may have an elongated channel in a sidewall; a rod which extends partially out of the body; and a spring disposed within the body in biasing contact with the rod. The rod may include a flexible tab matingly engaged within the channel, permitting the rod to translate within the hollow cylindrical body without falling out. The hollow cylindrical body may have an end with an opening bounded by an inward facing ledge, and the rod may include a radial ledge, such that the rod can translate within the body but cannot fall out due to interference between the inward facing ledge and the radial ledge. The spindle may include a friction hub disposed about and
(Continued)

rotatable around the hollow cylindrical body between ends of the body.

14 Claims, 31 Drawing Sheets

(51) Int. Cl.
*B65H 75/08* (2006.01)
*B65H 16/04* (2006.01)
*A47K 10/40* (2006.01)
*B65H 16/02* (2006.01)
*A47K 10/32* (2006.01)

(52) U.S. Cl.
CPC ..... *A47K 10/405* (2013.01); *B65H 16/02* (2013.01); *B65H 16/04* (2013.01); *B65H 19/10* (2013.01); *B65H 75/08* (2013.01); *A47K 2010/3206* (2013.01); *B65H 2301/41306* (2013.01); *B65H 2301/41308* (2013.01); *B65H 2301/41335* (2013.01); *B65H 2301/413243* (2013.01)

(58) Field of Classification Search
CPC ..... B65H 75/08; B65H 2301/41306; B65H 2701/533; B65H 2701/1846
See application file for complete search history.

(56) References Cited

U.S. PATENT DOCUMENTS 1,217,211 A * 2/1917 Pico ..... A47K 10/40 242/596.4
1,281,861 A 10/1918 Sibley
1,308,912 A * 7/1919 MacCormac ..... A47K 10/38 242/565
1,391,326 A * 9/1921 Kiillian ..... A47K 10/38 242/599
1,778,856 A * 10/1930 Hoegger ..... A47K 10/22 242/565
1,928,979 A 10/1933 Robert
2,248,716 A 7/1941 Markle, Jr.
2,443,243 A 6/1948 Hayssen
2,546,820 A * 3/1951 Grant ..... A47K 10/40 242/599.3
2,670,905 A 3/1954 Theodor
2,711,860 A * 6/1955 Layton ..... A47K 10/3845 242/596.8
2,749,056 A * 6/1956 Jenkins ..... A47K 10/38 242/422.5
2,889,122 A * 6/1959 McConnell ..... A47K 10/40 242/599.1
2,952,418 A 9/1960 Rice
3,211,504 A 10/1965 Bump
3,285,528 A 11/1966 Beindorf
3,362,653 A * 1/1968 Edward ..... A47K 10/32 242/599.1
3,375,995 A 4/1968 Roman
3,467,456 A * 9/1969 Chmela ..... A47K 10/40 242/598.6
3,516,615 A * 6/1970 Wickenberg ..... A47K 10/38 242/596.3
3,601,328 A * 8/1971 McClung ..... A47K 10/40 242/599
3,770,222 A 11/1973 Jespersen
3,788,573 A 1/1974 Thomson et al.
3,837,595 A * 9/1974 Boone ..... A47K 10/32 242/594.5
3,917,185 A 11/1975 Canada
4,067,511 A 1/1978 Hermanns
4,149,682 A 4/1979 Gustafson
4,222,532 A 9/1980 DeLuca
4,300,727 A 11/1981 Koch et al.
4,314,678 A * 2/1982 Upchurch ..... A47K 10/40 242/599.1
4,354,644 A 10/1982 Grant
4,436,249 A 3/1984 Santa et al.
4,447,015 A 5/1984 Peterson
4,771,966 A * 9/1988 Anderson ..... A47K 10/40 225/51
5,249,755 A 10/1993 Jespersen
5,273,229 A 12/1993 Komatsu
5,277,375 A 1/1994 Dearwester
5,323,980 A 6/1994 Neveu et al.
5,366,175 A 11/1994 Schutz
5,370,336 A * 12/1994 Whittington ..... A47K 10/3836 242/560.2
5,370,339 A 12/1994 Moody et al.
5,374,008 A * 12/1994 Halvorson ..... A47K 10/40 242/598.3
5,445,345 A 8/1995 Neveu et al.
5,451,013 A 9/1995 Schutz
5,467,935 A * 11/1995 Moody ..... A47K 10/40 242/422.4
5,492,280 A 2/1996 Corres et al.
5,495,997 A 3/1996 Moody
5,509,593 A 4/1996 Bloch et al.
5,524,835 A 6/1996 Collins
5,577,686 A 11/1996 Moody
5,645,244 A 7/1997 Moody
5,669,576 A 9/1997 Moody
5,727,751 A * 3/1998 Liu ..... A47K 10/40 242/599.1
5,749,538 A 5/1998 Brown et al.
5,758,843 A * 6/1998 Ongaro ..... A47K 10/3836 242/563.2
5,803,399 A 9/1998 Hashikawa
5,813,624 A 9/1998 Grasso et al.
5,868,342 A 2/1999 Moody et al.
5,904,316 A 5/1999 Dunning et al.
5,947,409 A 9/1999 Corrigan, Jr.
5,988,561 A * 11/1999 Mele ..... A47K 10/40 242/599.1
6,036,134 A 3/2000 Moody
6,056,235 A 5/2000 Brozinsky
6,155,517 A 12/2000 Lippold et al.
6,199,791 B1 3/2001 Conran et al.
6,202,956 B1 3/2001 Grasso et al.
6,241,180 B1 6/2001 Potter
6,308,910 B1 * 10/2001 Booth ..... A47K 10/40 242/565
6,328,246 B1 12/2001 Hjort et al.
6,378,800 B1 * 4/2002 Apichom ..... A47K 10/40 242/560
6,402,085 B1 * 6/2002 Smith ..... A47K 10/40 242/578
6,416,014 B2 7/2002 Van
6,609,678 B2 8/2003 Seybold et al.
6,688,551 B1 * 2/2004 He ..... A47K 10/40 239/52
6,752,349 B2 6/2004 Moody et al.
6,902,133 B1 6/2005 Black
7,083,138 B2 8/2006 Elliott et al.
7,275,655 B2 10/2007 Duff
7,395,986 B1 7/2008 Haering
7,422,174 B2 9/2008 Elliott et al.
7,461,810 B2 12/2008 Goeking et al.
7,648,097 B2 1/2010 Cattacin et al.
7,832,678 B2 11/2010 Hjort
7,841,558 B2 11/2010 Elliott et al.
7,861,964 B2 1/2011 Cittadino et al.
7,891,600 B1 * 2/2011 Schmatz ..... A47K 10/40 242/598.3
7,980,506 B2 7/2011 Kling et al.
8,398,014 B2 3/2013 Andersson
8,584,982 B2 * 11/2013 Eakin ..... A47K 10/38 242/598.5
D703,461 S 4/2014 Myron
8,740,132 B2 6/2014 Kling et al.
8,783,600 B1 7/2014 Myron

(56) References Cited

U.S. PATENT DOCUMENTS

| | | | | |
|---|---|---|---|---|
| 8,905,346 | B2 * | 12/2014 | Repp | B65H 19/126 242/559.2 |
| 9,056,504 | B2 * | 6/2015 | Sauvage | B65H 16/06 |
| 9,085,438 | B2 | 7/2015 | Wilkins | |
| 9,326,648 | B2 | 5/2016 | Trampolski | |
| 9,398,834 | B2 | 7/2016 | Benedetti | |
| 9,635,985 | B2 * | 5/2017 | Phelps | A47K 10/40 |
| 9,635,986 | B2 * | 5/2017 | Phelps | A47K 10/40 |
| 9,642,504 | B2 | 5/2017 | Andersson | |
| 9,648,995 | B2 | 5/2017 | Elliott et al. | |
| 9,861,238 | B2 | 1/2018 | Phelps | |
| 9,918,598 | B2 | 3/2018 | Osborne | |
| 10,238,246 | B2 * | 3/2019 | Cittadino | A47K 10/38 |
| 10,743,723 | B2 * | 8/2020 | Rozek | A47K 10/38 |
| 10,765,273 | B1 * | 9/2020 | Work | A47K 10/405 |
| 10,952,570 | B2 * | 3/2021 | Robertson | B65H 16/04 |
| 11,148,893 | B2 * | 10/2021 | Philipse | B41J 15/042 |
| 11,272,816 | B2 * | 3/2022 | Keskin | A47K 10/22 |
| 11,311,152 | B2 * | 4/2022 | Rozek | A47K 10/38 |
| 2002/0134881 | A1 * | 9/2002 | Hoernig | A47K 10/40 242/599.1 |
| 2003/0106957 | A1 | 6/2003 | Seybold et al. | |
| 2004/0011914 | A1 * | 1/2004 | Gandini | B65H 19/126 242/559.4 |
| 2005/0067424 | A1 | 3/2005 | Duff | |
| 2005/0139721 | A1 | 6/2005 | Andersson | |
| 2008/0001020 | A1 * | 1/2008 | Burnett | A47K 10/40 242/599 |
| 2008/0035696 | A1 | 2/2008 | Nichols et al. | |
| 2008/0087759 | A1 | 4/2008 | Cittadino et al. | |
| 2008/0142542 | A1 * | 6/2008 | Petry | A47K 10/42 242/598.6 |
| 2009/0057169 | A1 | 3/2009 | Kruchoski | |
| 2009/0236464 | A1 | 9/2009 | Cittadino | |
| 2010/0213303 | A1 | 8/2010 | Sanders | |
| 2010/0236956 | A1 | 9/2010 | Kling et al. | |
| 2012/0097790 | A1 | 4/2012 | Wilkins et al. | |
| 2012/0104142 | A1 | 5/2012 | Phelps | |
| 2012/0104143 | A1 | 5/2012 | Phelps | |
| 2012/0111987 | A1 * | 5/2012 | Phelps | B65H 75/185 242/560 |
| 2014/0070044 | A1 * | 3/2014 | Repp | B65H 19/126 242/558 |
| 2014/0320582 | A1 * | 10/2014 | Sauvage | B65H 16/06 347/218 |
| 2014/0367507 | A1 | 12/2014 | Trampolski | |
| 2015/0136894 | A1 | 5/2015 | Kling | |
| 2015/0307315 | A1 | 10/2015 | Techlin et al. | |
| 2016/0037979 | A1 | 2/2016 | Mattheeussen | |
| 2016/0058251 | A1 * | 3/2016 | Rudnick | A47K 10/40 242/599.1 |
| 2016/0280505 | A1 | 9/2016 | Stinson | |
| 2017/0071421 | A1 | 3/2017 | Hagleitner | |
| 2018/0146829 | A1 | 5/2018 | Osborne | |
| 2018/0199768 | A1 * | 7/2018 | Paladino | A47K 10/38 |
| 2018/0325333 | A1 | 11/2018 | Murphy et al. | |
| 2020/0062524 | A1 * | 2/2020 | Philipse | B65H 16/06 |
| 2020/0102180 | A1 * | 4/2020 | Robertson | A47K 10/16 |
| 2020/0102181 | A1 * | 4/2020 | Rozek | A47K 10/38 |
| 2020/0329924 | A1 * | 10/2020 | Rozek | A47K 10/38 |
| 2021/0059485 | A1 * | 3/2021 | Keskin | B65H 16/06 |
| 2021/0106187 | A1 * | 4/2021 | Murphy | A47K 10/38 |
| 2021/0121026 | A1 * | 4/2021 | Wicker | B65H 75/30 |
| 2021/0298541 | A1 * | 9/2021 | Robertson | B65H 16/04 |
| 2021/0354944 | A1 * | 11/2021 | Kambara | B65H 19/30 |

FOREIGN PATENT DOCUMENTS

| | | | |
|---|---|---|---|
| DE | 2000374 | A1 | 7/1971 |
| EP | 1033100 | A2 | 6/2000 |
| EP | 1559357 | A2 | 8/2005 |
| FR | 2669013 | A1 | 5/1992 |
| GB | 1385725 | A | 2/1975 |
| NL | 78196 | C | 1/1955 |
| SE | 520326 | C2 | 6/2003 |
| WO | 9310700 | A1 | 6/1993 |
| WO | 9623719 | A1 | 8/1996 |
| WO | 9704699 | A1 | 2/1997 |
| WO | 9737918 | A1 | 10/1997 |
| WO | 9817924 | A1 | 4/1998 |
| WO | 2007111561 | A1 | 10/2007 |
| WO | 2008004919 | A1 | 1/2008 |
| WO | 2008004920 | A1 | 1/2008 |
| WO | 2010011165 | A1 | 1/2010 |
| WO | 2011002360 | A1 | 1/2011 |
| WO | 2014007690 | A1 | 1/2014 |
| WO | 2017084689 | A1 | 5/2017 |

OTHER PUBLICATIONS

Feb. 4, 2020 Search Report and Written Opinion issued in International Patent Application No. PCT/US2019/053195.

Notice of Allowance received for U.S. Appl. No. 16/145,876, dated Apr. 9, 2020, 7 pages.

Notice of Allowance received for U.S. Appl. No. 16/922,070, dated Jan. 20, 2022, 7 pages.

U.S. Appl. No. 16/145,890, filed Sep. 28, 2018, entitled "Spindles and Dispensers for Sheet Product".

* cited by examiner

SPINDLE AND COVER COMPONENTS FOR SHEET PRODUCT DISPENSERS AND DISPENSER SYSTEMS INCLUDING SUCH COMPONENTS

CROSS-REFERENCE TO RELATED APPLICATIONS

This application claims priority to U.S. Provisional Patent Application No. 62/695,592 filed Jul. 9, 2018, which is incorporated herein by reference.

TECHNICAL FIELD

The present disclosure relates generally to sheet product dispensers and more particularly to various sheet product covers and sheet product spindles for use with sheet product dispensers, including but not limited to tissue dispensers for coreless tissue systems.

BACKGROUND

Sheet product dispensers, such as tissue paper dispensers, in hotels and higher end office spaces often, if not exclusively, are designed for core-based tissue rolls. These typically include one or two sheet product roll holder arms extending from a wall or counter cabinet. Such sheet product dispensers may dispense tissue inefficiently (e.g., by permitting freespinning, which causes more product than is needed to be dispensed per use) and/or may undesirably expose rolls of tissue to splashing. In addition, these conventional dispensers may be aesthetically unpleasant, e.g., the sight of an exposed, substantially depleted roll in a hotel room may be perceived as unhygienic and may cause hotel and office space management to replace tissue rolls before those rolls are depleted. Therefore, improved tissue dispensers are needed to address one or more of these deficiencies and perceptions.

BRIEF SUMMARY

In one aspect, new and improved spindles are provided, particularly for use with a coreless sheet product roll. In some embodiments, the spindle includes a hollow cylindrical body, which has at least one elongated channel in a sidewall of the body; a rod which extends partially out of a first end of the body; and a spring disposed within the hollow cylindrical body and having one end in biasing contact with an end of the rod disposed within the body, wherein the rod includes at least one flexible tab which is matingly engaged within the at least one channel, permitting the rod to translate within the hollow cylindrical body without being able to fall out of the body. The body may have a closed second end opposed to the first end, and the second end may include an integral disk as well as an integral end piece for mounting to a roller arm.

In another embodiment, the spindle includes a hollow cylindrical body comprising a first end which has an opening bounded by an inward facing ledge; a rod which extends partially out of the first end of the body and which comprises a radial ledge; and a spring disposed within the hollow cylindrical body and having one end in biasing contact with an end of the rod disposed within the body, wherein the rod is permitted to translate within the hollow cylindrical body but cannot fall out of the first end of the body due to interference between the inward facing ledge of the body and the radial ledge of the rod. In some variations of this embodiment, the body may include an internal wall which divides the first hollow space open toward the first end and a second hollow space open toward the second end, wherein the second hollow space is configured to receive an elongated end piece for mounting the spindle.

In yet another embodiment, the spindle includes a hollow cylindrical body; a rod which extends partially out of the first end of the body; a spring disposed within the hollow cylindrical body and having one end in biasing contact with the end of the rod disposed within the body; and a friction hub disposed around the hollow cylindrical body between ends of the body, the friction hub being rotatable around the body, wherein the rod is configured to translate within the hollow cylindrical body without being able to fall out of the body. The body may have at least one radial channel in the outer surface of the body and the friction hub may include at least one member engaged in the radial channel to limit axial translation of the friction hub relative to the body. The body may have a second end opposed to the first end and the second end comprises an opening which is closed off by an end cap secured to the second end of the body, wherein the end cap includes an end piece for mounting to a roller arm. In some variations, the rod has a spring-facing end which comprises an anchor which is configured to slide within channels in the inner surface of the body but cannot fall out of the first end of the body due to interference between at least one ledge of the anchor and at least one end wall of the channels.

In another aspect, new and improved cover assemblies are provided, particularly for use with a coreless sheet product roll. In some embodiments, the cover assembly includes a mounting member for securing the assembly to a surface; a pair of arms spaced for securing a spindle and a roll of sheet product therebetween; and a cover connected to the mounting member and disposed over a space between the pair of arms, wherein at least one of the arms comprises (i) a bearing for receiving a mounting end of the spindle and (ii) an adjustable clamp disposed about and in contact with the bearing. In some variations, the bearing and the clamp are concealed in a compartment within the at least one arm. The bearing may include a non-cylindrical recess configured to receive a non-cylindrical mounting end, such that the mounting end is rotationally fixed with the bearing.

These and other aspects and improvements of the present disclosure will become apparent to one of ordinary skill in the art upon review of the following detailed description when taken in conjunction with the several drawings and the appended claims.

DETAILED DESCRIPTION

Figure 1A:
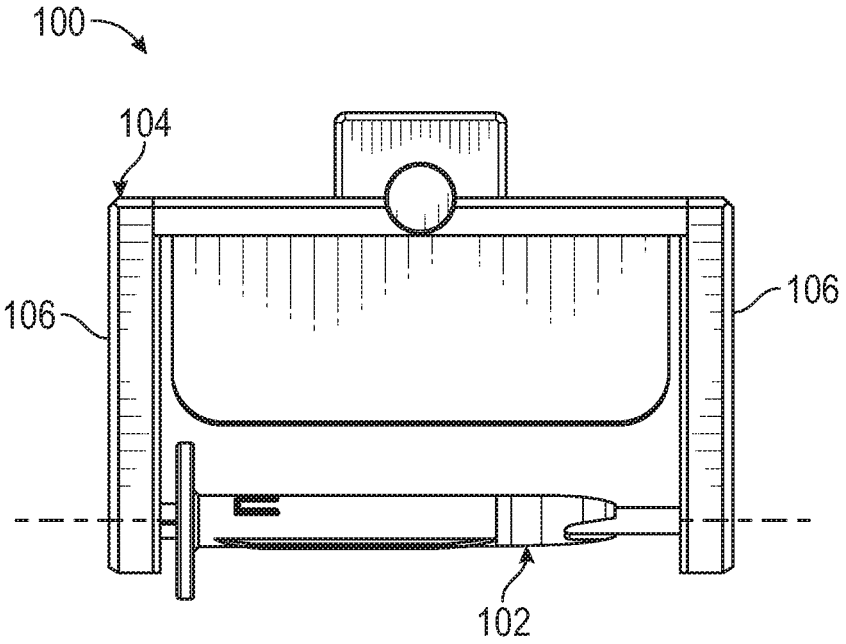
FIG. 1A is a front view of an embodiment of a sheet product dispenser assembly, without sheet product, comprising a cover assembly and a spindle.

In one aspect, the present disclosure addresses the foregoing shortcomings of sheet product dispensers by replacing the core-based tissue rolls with coreless sheet rolls and by providing improved tissue dispenser spindles, covers, assemblies and kits of components for retrofitting core-based dispenser systems. The improved tissue dispenser spindles and covers are adapted for retrofit of the core-based tissue dispensers, e.g., to cooperate, i.e., operably engage with, with conventional roll holder arms, typically found in hotels and higher end office spaces.

The presently disclosed dispenser systems advantageously may modify or increase pull force to reduce waste, save money on labor, reduce mess, and improve quality perceptions. The covered rolls also may provide a hygienic benefit to the user.

The present disclosure includes embodiments of sheet product dispenser systems, spindles, adaptors, and covers, which may be used together in various combinations. The embodiments are described in detail herein to enable one of ordinary skill in the art to practice the sheet product dispensers and related methods, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

As used herein, the term "sheet product" may include a product that is relatively thin in comparison to its length and width. For example, the sheet product may have a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be readily separated by a user.

In embodiments for use with the present dispenser systems and components, the sheet product is in the form of a roll, particularly a coreless sheet product roll. In a coreless sheet product roll, the layers of the sheet product are not wound around a core of paperboard or other material; instead, the inner layer of the roll is defined by the sheet product itself. A coreless sheet product has an opening that has a reduced diameter in comparison to a conventional retail bath tissue roll. The coreless roll has an opening, but it is not conventionally sized.

In some embodiments of the present sheet product dispensers, a spindle is inserted into a roll of sheet product. The roll holder typically may include a pair of roll holder arms fixed to a wall or other surface. The holder arms typically include a hole (round or square) into which ends of the spindle are engaged. In some embodiments, the holder may be recessed into a wall or cabinet, or mounted underneath a countertop. In some embodiments, the dispensers and assemblies further include a cover assembly, which surrounds some portion of the roll of sheet product when the roll is mounted onto the spindle. In some embodiments, the roll holder arms include a slot instead of a hole for engaging the spindle.

In some preferred embodiments, the roll holder and roll holder arms are conventional ones that operate (dispense) solely by manual, mechanical action (i.e., no electronics are involved in the dispensing). In some of these embodiments, the presently disclosed spindles and cover assemblies are configured to be retrofit to be operable with those conventional roll holders, e.g., to replace the conventional spindle with the present spindles configured for use with a coreless roll of sheet product.

The spindles described herein can be inserted into coreless sheet product roll. Opposed ends of the spindle may be releasably compressed toward one another to mount the spindle and roll between a pair of roll holder arms. For example, one or both ends of the spindle may engage with a bearing within each roll holder arm. A grip may disposed about the bearing to increase friction against the rotational movement of the bearings and the mounted sheet product spindle. The increase in frictional force acting upon the bearing may reduce waste by reducing freespinning.

Various embodiments of the spindles and cover assemblies are described herein. It is understood that features from different illustrated embodiments may be combined together to produce other variations of spindles and cover assemblies that are included within the scope of the present disclosure.

In one aspect, cover assemblies are provided for use with sheet product rolls, such as coreless sheet product roll. In some embodiments, the cover assembly includes (i) a mounting member for securing the assembly to a surface (e.g., a wall); (ii) a pair of arms spaced for securing a spindle and a roll of sheet product therebetween; and (iii) a cover connected to the mounting member and disposed over a space between the pair of arms, wherein at least one of the arms includes (a) a bearing for receiving a mounting end of the spindle and (b) an adjustable clamp disposed about and in contact with the bearing. The bearing and the clamp may be concealed in a compartment within the at least one arm. The bearing may include a non-cylindrical recess configured to receive a non-cylindrical mounting end, such that the mounting end is rotationally fixed with the bearing.

Figure 1B:
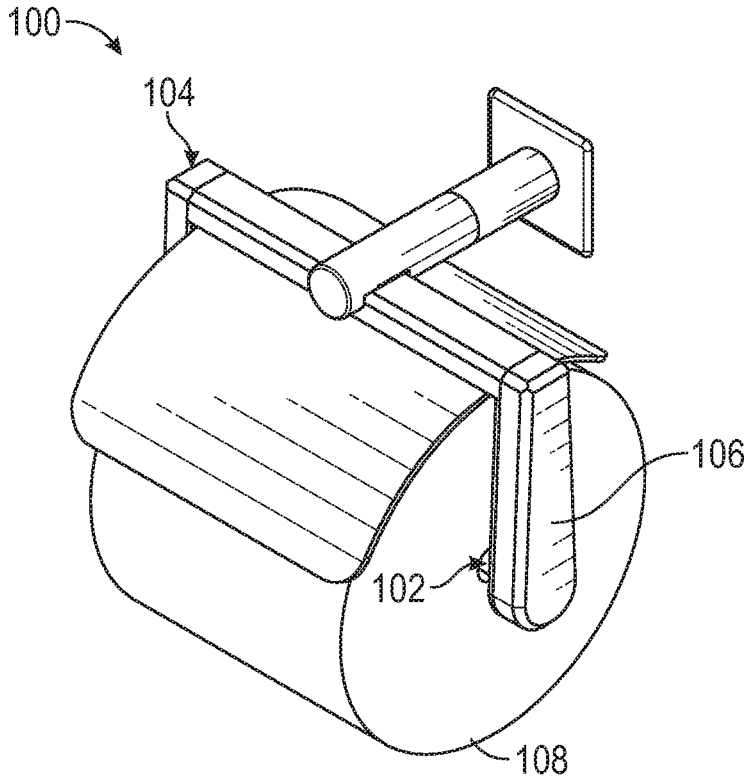
FIG. 1B is a perspective view of the sheet product dispenser assembly of FIG. 1A with an installed roll of sheet product.

For example, FIG. 1A illustrates a sheet product dispenser assembly 100, which includes a sheet product spindle 102 is mounted between a pair of roll product arms 106 of a cover assembly 104. The sheet product spindle 102 is configured (e.g., dimensioned) for insertion into a central opening of the coreless sheet product roll 108, for subsequent installation of the coreless sheet product roll 108 between the roll product arms 106 of the cover assembly 104 as shown in FIG. 1B.

Figure 2A:
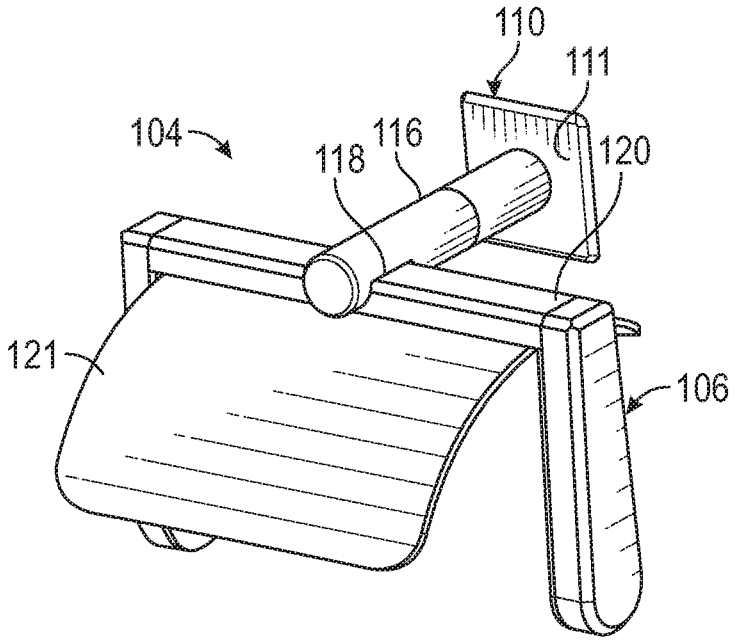
FIG. 2A is a front perspective view of the cover assembly shown in FIG. 1A.

As shown in FIG. 2A, the cover assembly 104 includes a mount 110 that is attachable to a wall or other vertical mounting surface. The back surface 112 of the mount 110 generally may be substantially flat and adapted for securement to the mounting surface by a fastener and/or adhesive. The mount 110 further includes a front surface 111 from which a cover rod 116 extends, e.g., perpendicularly, to position roll cover 121 and roll product arms 106 in a spaced position from the mounting surface. The cover rod 116 may have an elongated cylindrical shape, although other shapes are possible. In the illustrated embodiment, the cover rod 116 includes a cover rod recess 118 that receives a support for the rest of the cover assembly 104. Here, the cover rod recess 118 is secured about a middle portion of a strut 120 that extends laterally, e.g., substantially perpendicular to the longitudinal axis of the cover rod 116. The strut 120 may be attached to the cover rod 116 with one or more fasteners, by snap-fit engagement, and/or with an adhesive. In an alternative embodiment, the strut and cover rod are integrally formed as a single piece. A roll cover 121 is attached to the strut 120. The cover 121 is dimensioned and shaped to cover the upper portion of an installed roll of sheet product, potentially shielding the roll from contact with splattering liquid droplets. It may be curved to partially complement the shape of the roll of sheet product. Each of the opposing ends of the strut 120 is fixed to one of the roll holder arms 106.

Figure 2B:
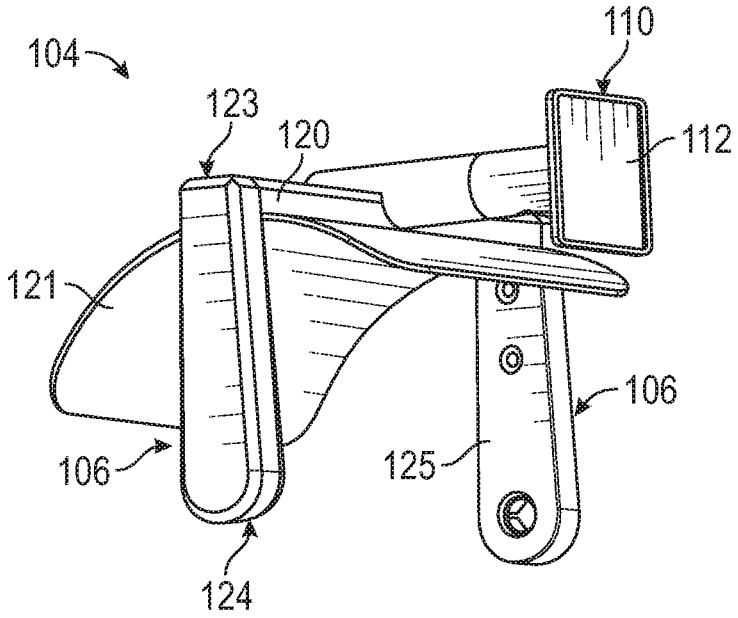
FIG. 2B is a rear perspective view of the cover assembly shown in FIG. 1A.

As shown in FIGS. 2A-2B, each of the two holder arms 106 has a first arm end 123 that is attached to one end of the strut 120. Each arm also has an second arm end 124 opposed to the first arm end 123. The arms 106 extend downwardly from the strut 120, symmetrically with respect to the cover rod. Each arm 106 may have a slight taper when viewed from the ends, wherein the first arm end 123 is slightly narrower than the second arm end 124. The second arm end 124 may have an arcuate shape and be slightly enlarged to accommodate internal components, as described below.

Figure 2C:
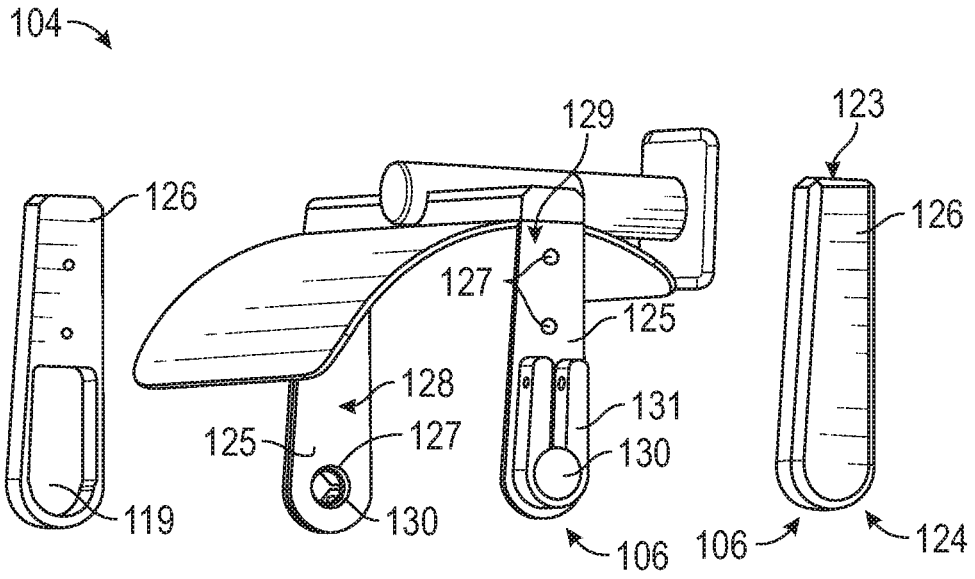
FIG. 2C is an exploded view of the cover assembly shown in FIG. 1A, in which arm covers are shown removed to reveal a clamp and a bearing for use in securing the spindle.

As shown in FIG. 2C, the arm 106 includes a base 125 and an arm cover 126 having a shape complementary to the shape of the base 125. The base 125 has a series of apertures 127 extending between a first base side 128 and a second base side 129. For example, the illustrated arm 106 includes two apertures disposed toward the first arm end 123 that are configured to receive fasteners to secure the arm cover 126. Another aperture disposed toward the second arm end 124 is configured to receive an end portion of a spindle. The assembly includes a circular adaptor in the form of a bearing 130. The bearing 130 disposed on the second base side 129 is configured to receive the end of the spindle extending through the aperture 127. An adjustable clamp 131 is secured about the bearing 130, which freely rotates. When the arm cover 126 is secured to the base 125, the bearing 130 and clamp 131 are disposed within recess 119 of the arm cover 126. The bearing and clamp may be provided in one or both roller arms.

In operation, within at least one arm 106, the bearing 130 is fixedly engaged with an end of the spindle, and the bearing is rotatably engaged within an opening in the clamp 131. For example, a non-circular end piece at one end of the spindle may key into a non-circular recess in the bearing in one roller arm, while the other end of the spindle floats freely in an aperture in the other arm. The clamp includes a set screw that can be adjusted to loosen or tighten the frictional engagement between the bearing and clamp, which in turn impacts the rotational frictional force interaction between the components and therefore may be used to control the drag on the bearing and thus the pull force resistance that a user experiences when pulling sheet product from the roll. The arm cover may include a single aperture positioned to access the set screw without removing the cover.

Figure 3A:
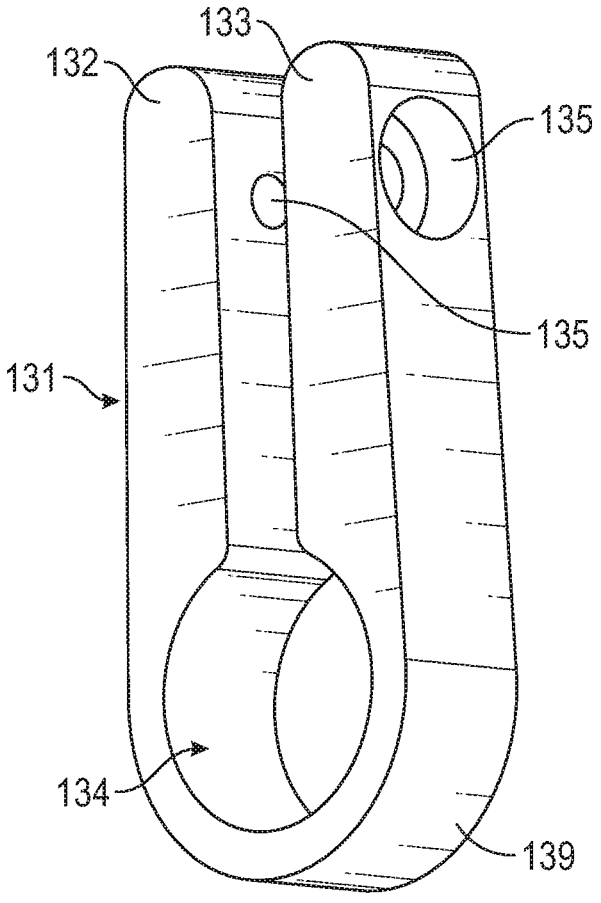
FIG. 3A is a perspective view of the clamp shown in FIG. 2C.
Figure 3B:
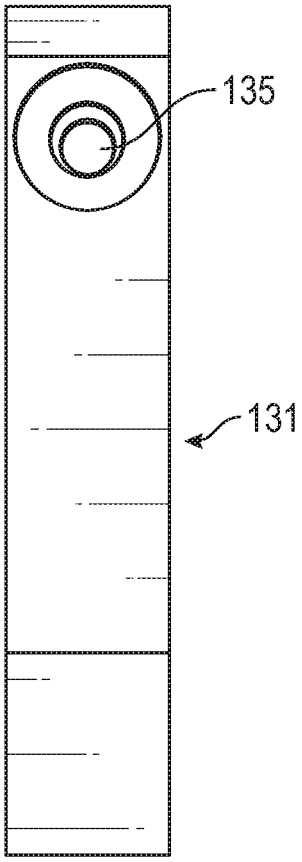
FIG. 3B is a side view of the clamp shown in FIG. 3A.

As shown in FIGS. 3A-3B, the clamp 131 includes a pair of clamp arms 132, 133 extending from an arcuate base end 139. The clamp arms 132, 133 include fastener apertures 135, which are aligned to receive a set screw or other adjustable fastener (not shown) which can be adjusted (e.g., rotated clockwise or counterclockwise) to increase or decrease the space between clamp arms 132 and 133, which proportionally increases or decreases the diameter of the opening bounded by arcuate surface 134. For example, decreasing the diameter of this opening, increases the area of the arcuate surface 134 in contact with bearing 130.

Figure 4A:
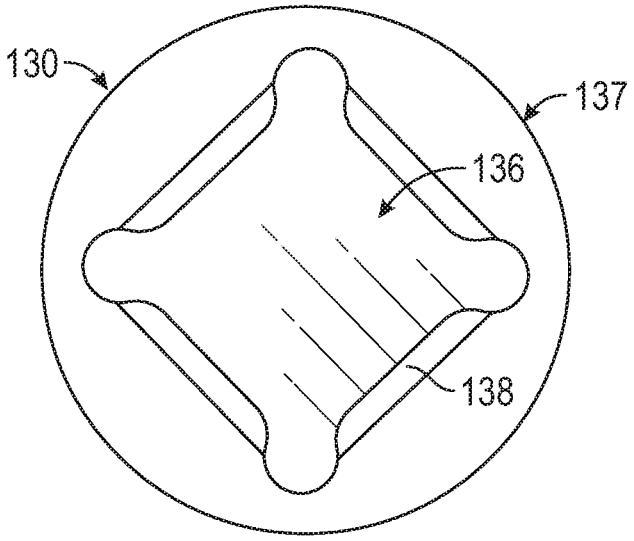
FIG. 4A is a front view of the bearing shown in FIG. 2C.
Figure 4B:
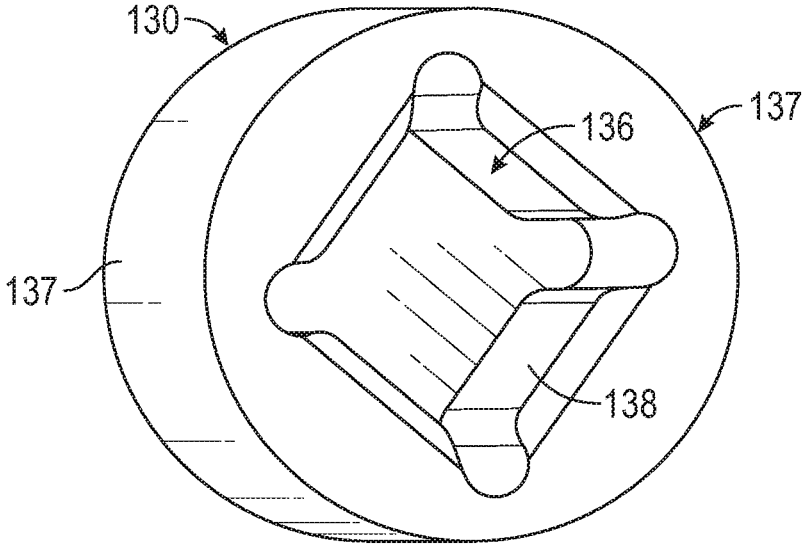
FIG. 4B is a perspective view of the bearing shown in FIG. 4A.

FIGS. 4A-4B illustrate one embodiment of a bearing 130. The bearing 130 includes an cylindrical outer surface 137 and a recess 136 which is defined at least in part by a series of flat side walls 138. The series of flat side walls 138 are arranged to secure with an end portion of a spindle. The recess 136 can have essentially any shape suited to receive and hold the end of a spindle such that the spindle and the bearing have positions fixed with respect to one another, whereby the bearing and spindle are configured to rotate together. The outer surface 137 of the bearing contacts and rotates against arcuate surface 134 of the clamp 131.

Figure 5A:
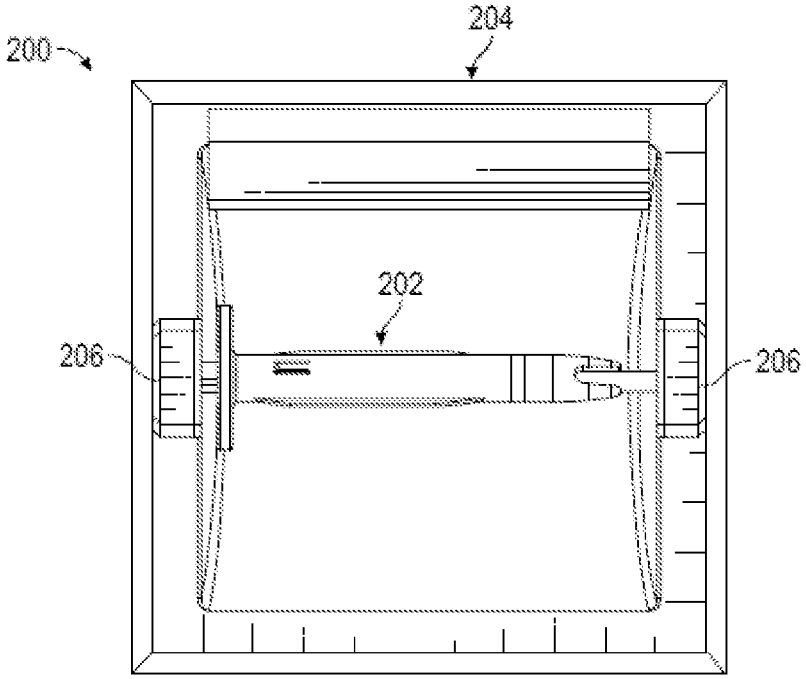
FIG. 5A is a front view of another embodiment of a sheet product dispenser assembly, without sheet product, comprising a cover assembly and a spindle.
Figure 5B:
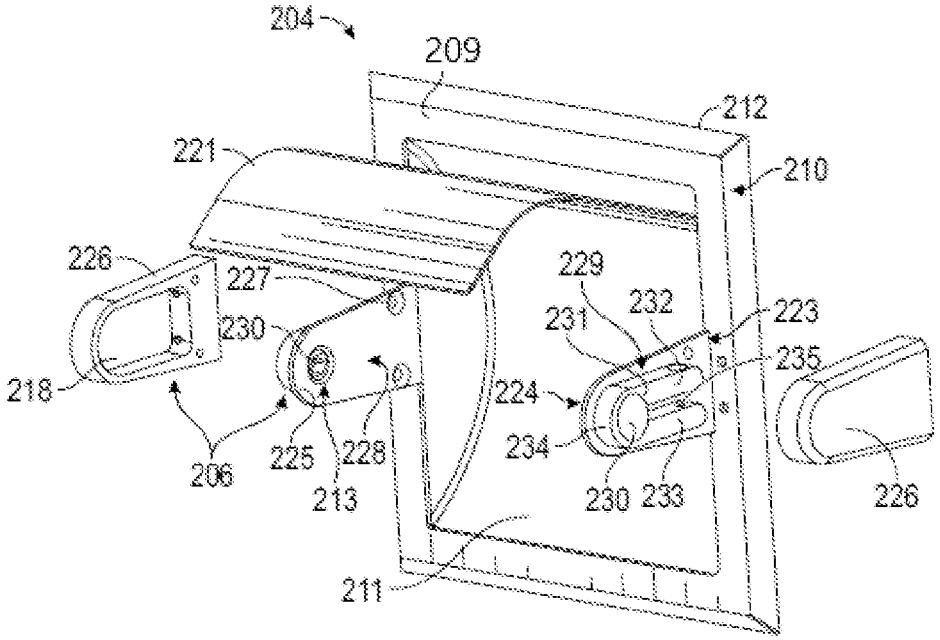
FIG. 5B is a perspective, partially exploded view of the sheet product dispenser assembly of FIG. 5A, which view reveals a clamp and a bearing for use in securing the spindle (not shown).
Figure 5C:
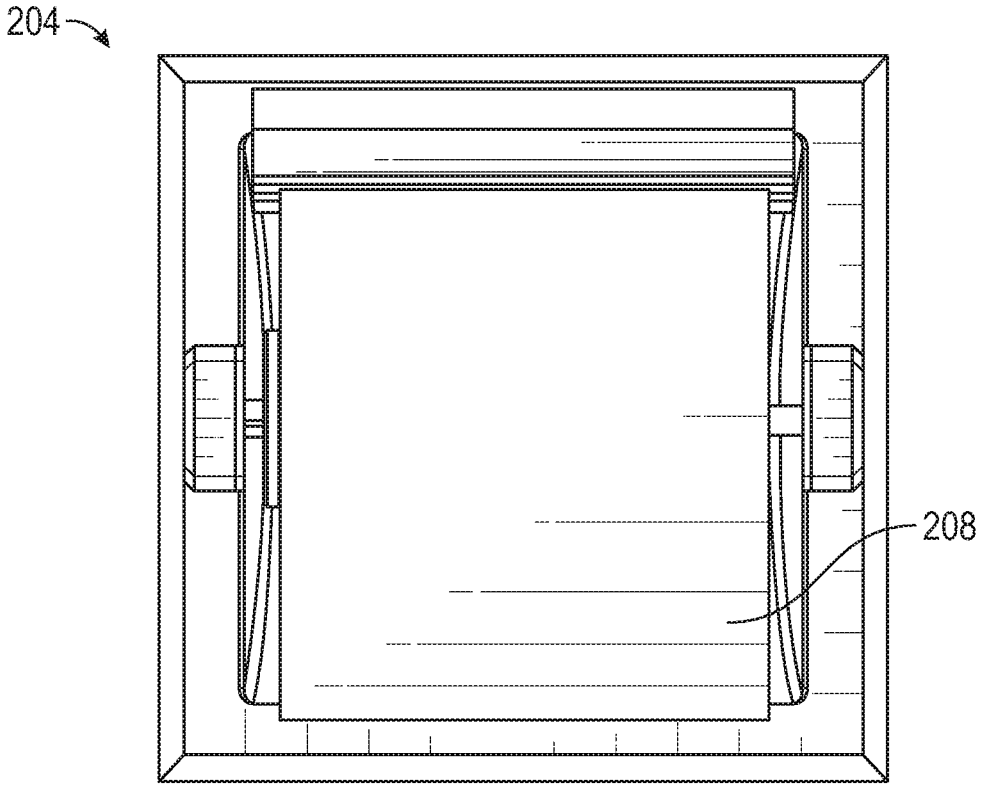
FIG. 5C is a front view of the sheet product dispenser assembly of FIG. 5A, with a roll of sheet product installed.
Figure 5D:
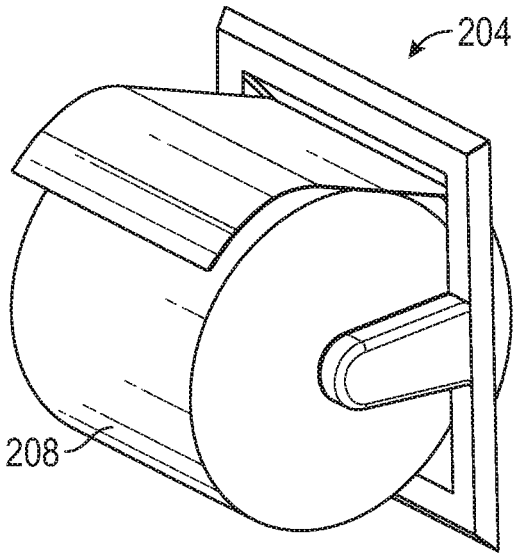
FIG. 5D is a perspective view of the sheet product dispenser assembly with sheet product shown in FIG. 5C.

FIGS. 5A-5D illustrate another embodiment of the sheet product dispenser assembly 200. The dispenser assembly 200 includes a cover assembly 204 and sheet product spindle 202. The sheet product spindle 202 mounts within the cover assembly 204 between the arms 206. The sheet product spindle 202 is configured to be inserted into a central opening of a coreless sheet product roll 208 and then installed into the arms 206, as shown in FIGS. 5C-5D. The sheet product roll 208 can then rotate with the sheet product spindle 202 within the cover assembly 204 to dispense product.

FIG. 5B shows details of the cover assembly 204. The cover assembly 204 includes a mount 210 that attaches to a wall or other mounting surface. The mount 210 includes a frame portion 212 and a concave rear wall 211, which extends into an opening in the mounting surface. A pair of arms 206 extending perpendicularly from the vertical side members of the frame portion of the mount 210. A roll cover 221 extends outwardly from the upper horizontal member 209 of the frame portion 212 of the mount 210. The roll cover 221 is dimensioned and shaped, e.g., at least partially curved, to cover part of the top and front portion of an installed roll of sheet product.

Each arm 206 has a first arm end 223 attached to the mount 210 and an opposed second arm end 224. The arm may taper from the first arm end toward the second arm end, as shown. Each arm 206 includes a base 225 and an arm cover 226 having a shape complementary to the shape of the base 225. The base 225 has a series of apertures extending between a first base side 228 and a second base side 229. For example, each arm 206 includes two apertures 227 disposed toward the first arm end 223 that are configured to receive fasteners to secure the arm cover 226. Another aperture 213 is disposed toward to the second arm end 224 and configured to receive an end portion of the spindle 202. A bearing 230 disposed on the second base side 229 is configured to receive the end of the spindle extending through the aperture 213. A clamp 231 is secured about the bearing 230. When the arm cover 226 is secured to the base 225, the bearing 230 and clamp 231 are covered, disposed within recess 218 of the arm cover 126.

In operation, within in each arm 206, the bearing 230 is fixedly engaged with the end of the spindle 202, and the bearing is rotatably engaged within an opening in the clamp 231. The clamp can be adjusted to loosen or tighten the frictional engagement between the bearing and clamp, as described above with respect to clamp 131 and bearing 130.

The clamp 231 includes a first clamp arm 232 and a second clamp arm 233 that extend outward from an arcuate base end 234. The clamp arms 232, 233 includes a set of fastener apertures 235, identical or similar to the apertures in the clamp shown in FIGS. 3A-3B, and aligned to receive a fastener adjustable to increase or decrease the space between clamp arms 232 and 233 to increase or decrease the area of the arcuate surface of the clamp in contact with bearing 230, as described above with reference to clamp 131 and bearing 130.

In some other embodiments, the spindle includes a hollow cylindrical body including a first end which has an opening bounded by an inward facing ledge; a rod which extends partially out of the first end of the body and which includes a radial ledge; and a spring disposed within the hollow cylindrical body and having one end in biasing contact with the end of the rod disposed within the body, wherein the rod is permitted to translate within the hollow cylindrical body but cannot fall out of the first end of the body due to interference between the inward facing ledge of the body and the radial ledge of the rod. In some variations of this embodiment, the body may include an internal wall which divides the first hollow space open toward the first end and a second hollow space open toward the second end, wherein the second hollow space is configured to receive an elongated end piece for mounting the spindle.

Figure 6A:
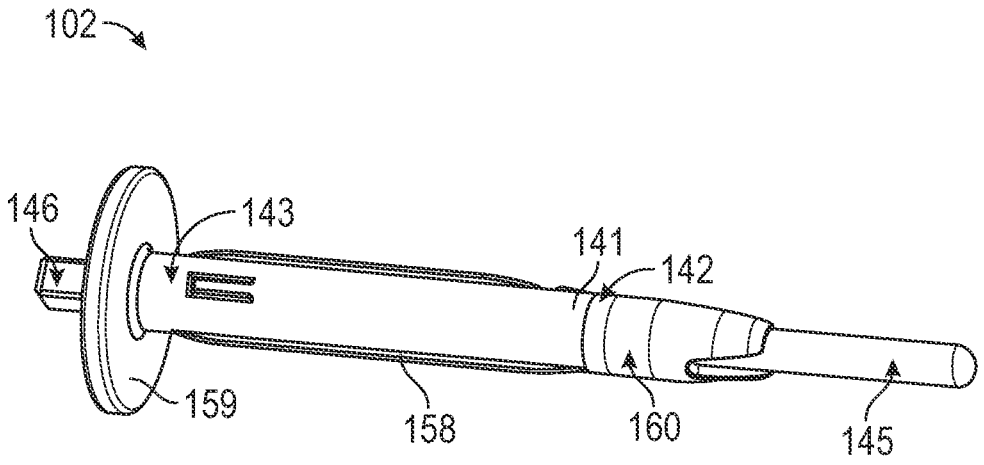
FIG. 6A is a perspective view of one embodiment of a sheet product spindle.
Figure 6B:
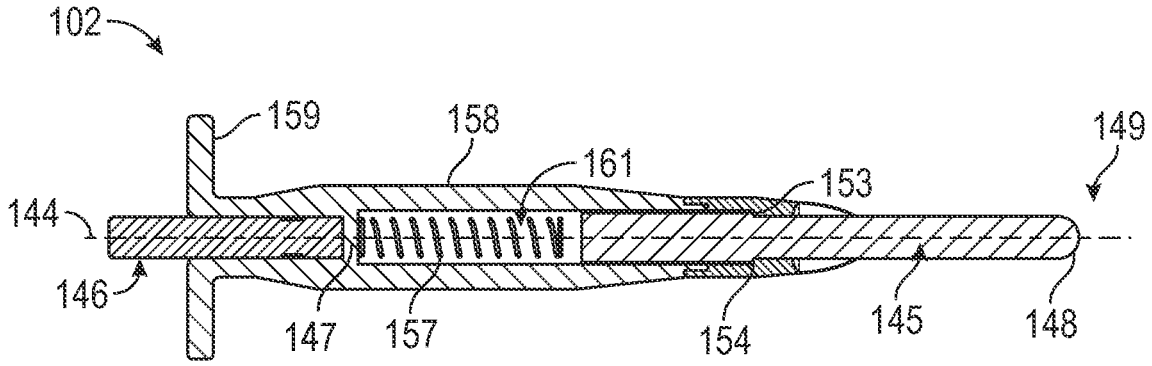
FIG. 6B is a side, cross-sectional view of the sheet product spindle shown in FIG. 6A.
Figure 6C:
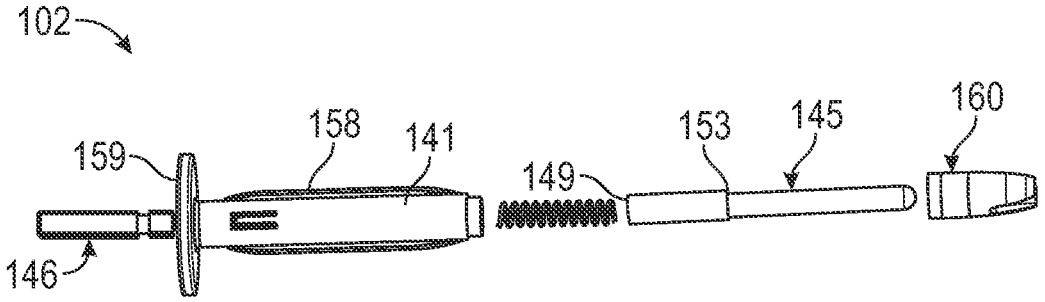
FIG. 6C is an exploded view of the sheet product spindle shown in FIG. 6A.

For example, FIGS. 6A-6C illustrate a sheet product spindle 102. The spindle 102 is configured for use with a coreless sheet product roll. The spindle 102 is configured to allow a user to obtain a length of sheet product from a sheet product roll 108 (e.g., as shown in FIG. 1B) by rotation of the roll with the spindle 102. The spindle 102 is dimensioned to be fit into and engage with a central opening of a coreless sheet product roll. The spindle 102 may be configured to rotate about a lateral axis 144 (e.g., as shown in FIG. 6B) to dispense the sheet product.

The sheet product spindle 102 includes a body 141 with a first end 142 and a second end 143. The body 141 includes a hollow shaft that receives a rod 145 and an end piece 146. The rod 145 is configured to translate telescopically within the hollow opening 161 of the body 141, along the lateral axis 144. Rod 145 has a circular cross-sectional shape. The first end 142 has an opening through which the rod 145 extends. The body 141 includes an internal wall 147 which separates the first hollow space open toward the first end 142 and a second hollow space open toward the second end 143 for receiving an end piece. The rod 145 includes a mounting end 148 and an opposed spring-facing end 149. The mounting end 148 of the rod 145 and/or the end piece 146 may be non-cylindrical, e.g., square, so that it is configured to engage the bearings of the cover assemblies described above.

The mounting end 148 advantageously may be shaped to facilitate insertion of the rod 145, and thus the spindle 102, into a central opening of a coreless roll of sheet product, and it may also ease removal of the coreless roll from the spindle 102 if necessary. Insertion can be difficult because coreless tissue product rolls may deform or partially collapse during shipping, storage, and handling, which can alter the roll geometry and therefore collapse or constrict the opening in the center of the roll. The spherical end of mounting end 148 can be pushed into such altered openings without damaging the roll, and without providing an edge that can snag the roll when removing a roll or partial roll from the spindle.

In use, a sheet product roll is disposed around the rod 145 and the body 141, between end piece 146 and mounting end 148. The body 141 and sheet product roll rotate about the rod 145, rotating along the lateral axis 144. In a particular embodiment, the sheet product roll is a coreless roll of bath tissue.

The spindle 102 also includes a ring 160 that is connected to the first end 142 of the body 141. In assembling the spindle, a compression spring 157 and the rod 145 are inserted into the hollow opening 161, and then the ring is fixed to the first end 142. The ring serves to retain the spring and rod within the body.

The rod 145 includes a ledge, or catch 153, and the inner surface of the ring 160 includes a ledge 154. The compression spring 157 causes the catch 153 on the rod 145 to abut the ledge 154 on the ring 160. The ledge 154 thereby limits telescopic extension of the rod 145, while permitting the rod to be displaced partially into the body 141, and compressing the spring 157, to facilitate installation (and removal) of the spindle 102 from a dispenser assembly.

In some embodiments, the rod 145 is a molded polymeric material. For example, the rod 145 may be formed of polyethylene terephthalate, polyethylene, polyvinyl chloride, polypropylene, polystyrene, polylactic acid, polycarbonate, acrylic, acetal, nylon, or acrylonitrile butadiene styrene. In some other embodiments, the rod 145 is formed of a metal or metal alloy, such as aluminum or steel.

The body 141 includes a pair of fins 158 extending outward from the body 141. In other embodiments, three, four, or more fins may be provided on the hollow shaft. The fins 158 may extend (in the axial direction) along all or a portion of the length of the cylindrical body portion. The shapes, sizes, and numbers of the fins may vary; however, suitable configurations are adapted to frictionally engage with a coreless roll of tissue product when the spindle 102 is inserted into the roll, thereby resisting spinning of the roll about the body 141.

The body 141 includes a disc 159 extending radially from the second end 143 of the body 141. The end piece 146 is anchored in an opening within the second end 143 of the body 141. The end piece is an elongated rectangular peg, with a portion extending through the disk 159 and into the first end 142 and another portion protruding out from the disk 159 and body 141. The end piece may be formed of a metal or a rigid polymer. The disc 159 may be circular as shown or any other suitable shape. The disc 159 may include an elastomeric surface on the surface facing the body 141. The disc 159 may include a colored ring or similar indicator to indicate when the sheet product roll is substantially depleted and in need of replacement.

In some embodiments, the mounting end 148 of rod 145 fits into the bearing 130 of one of the arms 106 of cover assembly 104 (or cover assembly 204), and the end piece 146 fits into an aperture in the other one of the arms 106, for example as shown in FIG. 1A (following loading of a roll of sheet product onto the spindle 102). The spindle 102 may be loaded into the roll holder by axially depressing rod 145 into the body 141, compressing the spring therein, and then releasing the rod once the ends are aligned with the apertures in the arms.

FIGS. 7A-D illustrate another embodiment of a sheet product spindle 202. The spindle 202 is also configured for use with a coreless sheet product roll and suitable for use with various cover assemblies, such as the cover assembly 104, to dispense the sheet product. This spindle embodiment consists of only three parts: a body, a spring, and a rod, which can be snapped together.

The sheet product spindle 202 includes a body 241 with a first end 242 and a second end 243. The body 241 includes a hollow shaft that receives a rod 245 and a compression spring 257. An end piece 246 and a disk 259 are integrally formed with the body 241. For instance, these features may be a single molded polymer structure. The disk 259 may extend radially from the second end 243 of the body 241. The rod 245 is configured to translate telescopically within the hollow opening of the body 241, along the lateral axis 244. The first end 242 has an opening through which the rod 245 extends. The rod 245 includes a mounting end 248 and an opposed spring-facing end 249. The mounting end 248 of the rod 245 and the end piece 246 may engage the bearing(s) of the cover assembly described herein.

Rod 245 has a non-circular cross-sectional shape. For example, it may be X-shaped. The rod 245 may be formed of a polymeric material, for example, by molding, extrusion, and/or other plastics fabrication processes. However, mounting end 248 may have a circular or non-circular cross-sectional shape.

The mounting end 248 may facilitate insertion of the rod 245, and thus the spindle 202, into a central opening of a coreless roll of sheet product, and it may also ease removal of the coreless roll from the spindle 202 if necessary, as described above.

In use, a sheet product roll is disposed around the rod 245 and the body 241, between end piece 246 and the mounting end 248. The body 241, the rod 245, and the sheet product roll rotate together along the lateral axis 244. In a particular embodiment, the sheet product roll is a coreless roll of bath tissue.

Figure 7A:
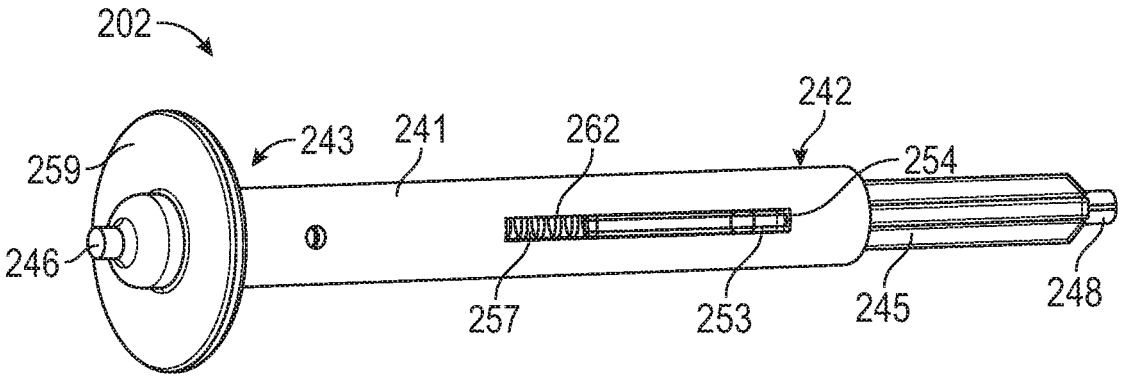
FIG. 7A is a perspective view of another embodiment of a sheet product spindle.
Figure 7B:
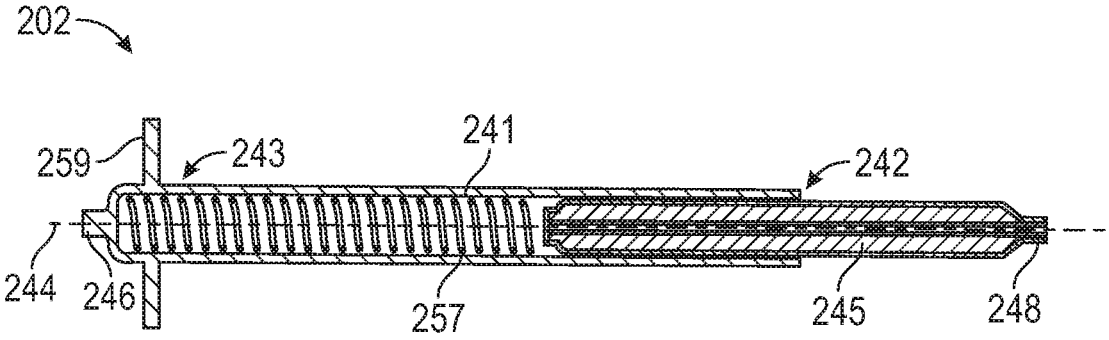
FIG. 7B is a side, cross-sectional view of the sheet product spindle shown in FIG. 7A.
Figure 7C:
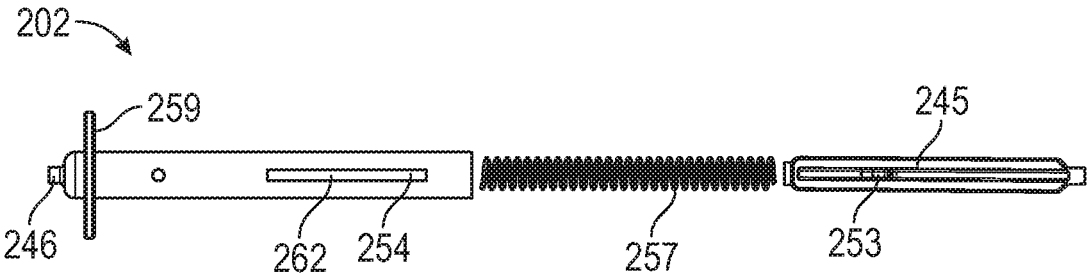
FIG. 7C is a first exploded view of the sheet product spindle shown in FIG. 7A.
Figure 7D:
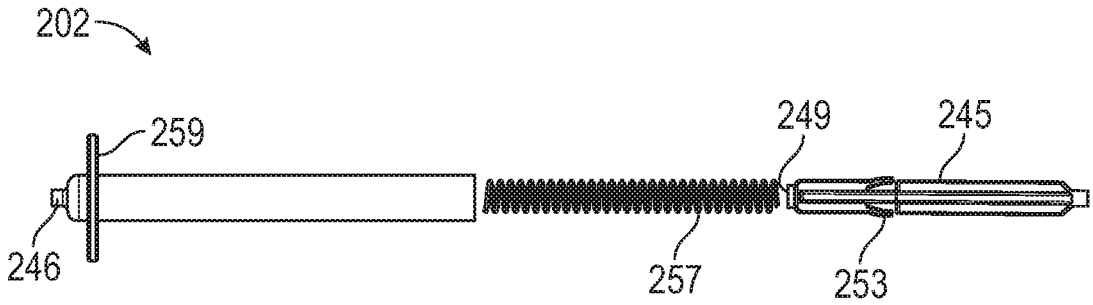
FIG. 7D is a second exploded view, rotated 90 degrees about the longitudinal axis of the spindle from first exploded view, of the sheet product spindle shown in FIG. 7A.

As shown in FIGS. 7A and 7D, the body 241 includes an elongated slot 262 in which a tab, or catch, 253 can translate. Only a single slot is visible, but an identical one is positioned on the opposed side of the body. As shown in FIG. 7D, the rod 245 includes a pair of the catches 253 extending on opposites of the rod 245. The catches 253 are shaped and dimensioned to permit spindle assembly by insertion of the rod 245 into the hollow opening at first end 242 of the body 241, after inserting the compression spring 257, where the insertion causes the catches 253 to snap or lock into the slots 262. The catches 253 then are able to limit telescopic extension of the rod 245 from the body 241 and keeping the rod 245 from falling out the body 241. That is, when the catch 253 abuts the slot end 254 near first end 242, then lateral translation of the rod out of the body is stopped.

In some embodiments, the rod 245 is a molded polymeric material. For example, the rod 245 may be formed of polyethylene terephthalate, polyethylene, polyvinyl chloride, polypropylene, polystyrene, polylactic acid, polycarbonate, acrylic, acetal, nylon, or acrylonitrile butadiene styrene. In some other embodiments, the rod 245 is formed of a metal or metal alloy, such as aluminum or steel.

The disc 259 may be circular as shown or any other suitable shape. The disc 259 may include an elastomeric surface on the surface facing the body 241. The disc 259 may include a colored ring or similar indicator to indicate when the sheet product roll is substantially depleted and in need of replacement.

The shapes of the ends of spindle 202 are positionally reversed compared that of the ends of spindle 102. That is, end piece 246 is round, whereas end piece 146 is square, and mounting end 248 is square, whereas mounting end 148 is round. This is relevant only so far as which end of the spindle is keyed into an adaptor (bearing) and which end is free floating. Otherwise, the two embodiments of spindles function similarly.

Figure 8A:
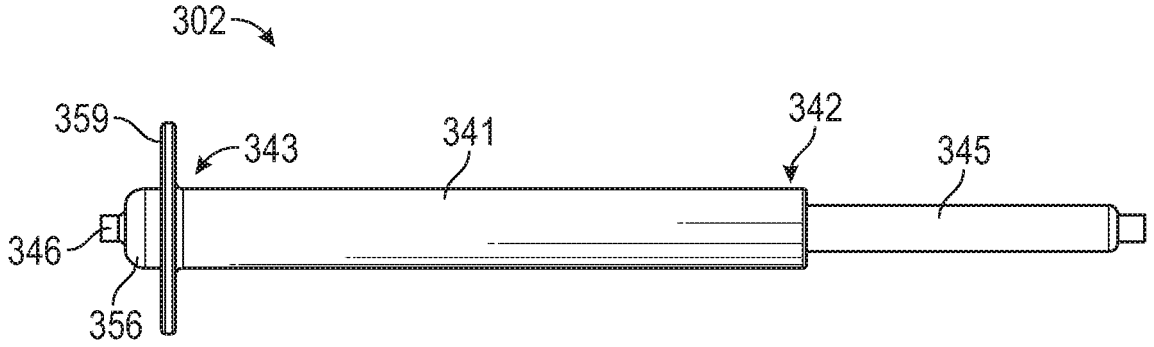
FIG. 8A is a plan view of another embodiment of a sheet product spindle.
Figure 8B:
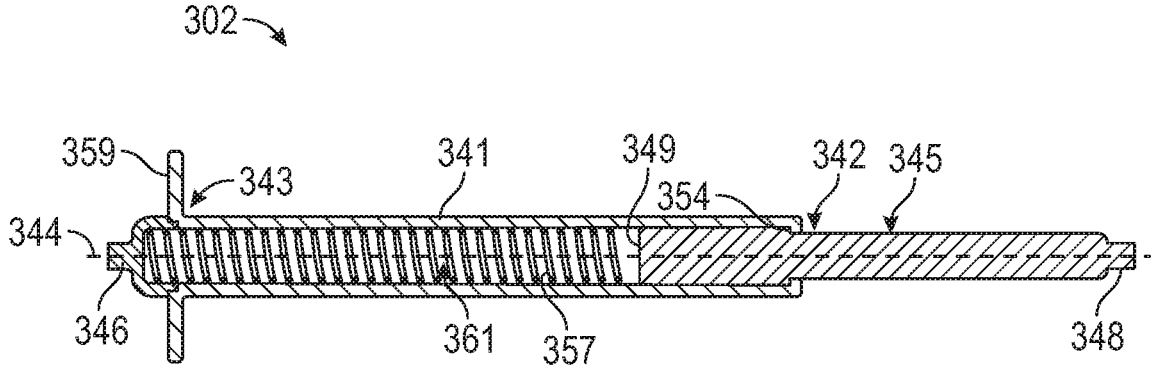
FIG. 8B is a cross-sectional view of the sheet product spindle shown in FIG. 8A.
Figure 8C:
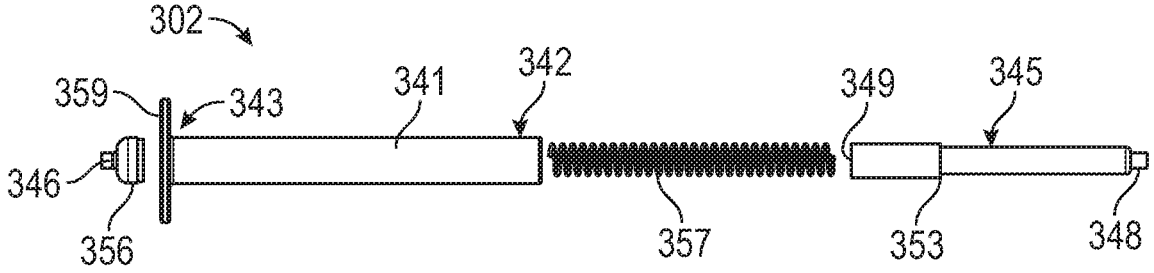
FIG. 8C is an exploded view of the sheet product spindle shown in FIG. 8A.

FIGS. 8A-8C illustrate yet another embodiment of a sheet product spindle 302. The spindle 302 is also configured for use with a coreless sheet product roll and suitable for use with various cover assemblies, such as the cover assembly 104, to dispense the sheet product. This spindle embodiment consists of four assembled parts: a body, an end cap, a spring, and a rod. The parts may be machined metal parts.

The sheet product spindle 302 includes a body 341 with a first end 342 and a second end 343. The body 341 includes a hollow shaft that receives a rod 345 and a compression spring 357. An end cap 356 is secured to the second end 346, closing off that end of the hollow shaft. The end cap 356 includes an end piece 346. The rod 345 is configured to translate telescopically within the hollow opening of the body 341, along the lateral axis 344. The first end 342 has an opening through which the rod 345 extends. The rod 345 includes a cylindrical mounting end 348 and an opposed spring-facing end 349. The mounting end 348 of the rod 345 and the end piece 346 may engage the bearing(s) of the cover assembly described herein.

A disk 359 is integrally formed with the body 341. The disc 359 may be circular as shown or any other suitable shape. The disk 359 may extend radially from the second end 343 of the body 341. The disc 359 may include a colored ring or similar indicator to indicate when the sheet product roll is substantially depleted and in need of replacement.

The mounting end 348 may facilitate insertion of the rod 345, and thus the spindle 302, into a central opening of a coreless roll of sheet product, and it may also ease removal of the coreless roll from the spindle 302 if necessary, as described above.

In use, a sheet product roll is disposed around the rod 345 and the body 341, between end piece 346 and the mounting end 348. The body 341 and sheet product roll rotate about the rod 345, rotating along the lateral axis 344. In a particular embodiment, the sheet product roll is a coreless roll of bath tissue.

Rod 345 has a circular cross-sectional shape. The rod 345 is configured to translate along the lateral axis 344. As shown in FIG. 8C, the rod 345 includes a ledge, or catch 353. The catch 353 serves to provide lateral surface(s) to abut an inner ledge 354 at the first end 342 of the body 341, limiting the telescopic extension of the rod and keeping the end 349 of the rod inside the inner volume 361 of the body 341. The compression spring 357 causes the catch 353 to abut the ledge 354 in the absence of a compressive load.

The spindle 302 is assembled by inserting the rod 345 and then the spring 357 into an opening at the second end 343 of the body 341, such that the mounting end of the rod extends out of the first end 342 of the body 341 and the spring 357 and spring-facing end 349 of the rod being retained in the inner volume 361 of the body 341. Then the end cap 356 is secured to second end 343 of the body 341 to close the opening and hold the four components together. The end cap may be secured to the body by an adhesive or by snap-fit or frictional engagement, or the end cap and body may include mating threads and grooves to permit the two parts to be screwed together. Other mechanical attachment means are also envisioned.

In some embodiments, the rod 345 is formed of a metal or metal alloy, such as aluminum or steel. In some other embodiments, the rod 345 is a molded polymeric material.

In some embodiments, the mounting end 348 of rod 345 fits into an aperture, with or without an adaptor, of a roll holder arm (which may be part of a cover assembly) and the end piece 346 fits another aperture, with or without an adaptor, of another roll holder arm (which may be part of a cover assembly). The spindle 302 may be loaded into the roll holder by axially depressing rod 345 into the body 341, compressing the spring 357, and then releasing the rod once the ends 346 and 348 are aligned with the apertures in the arms.

Figure 9A:
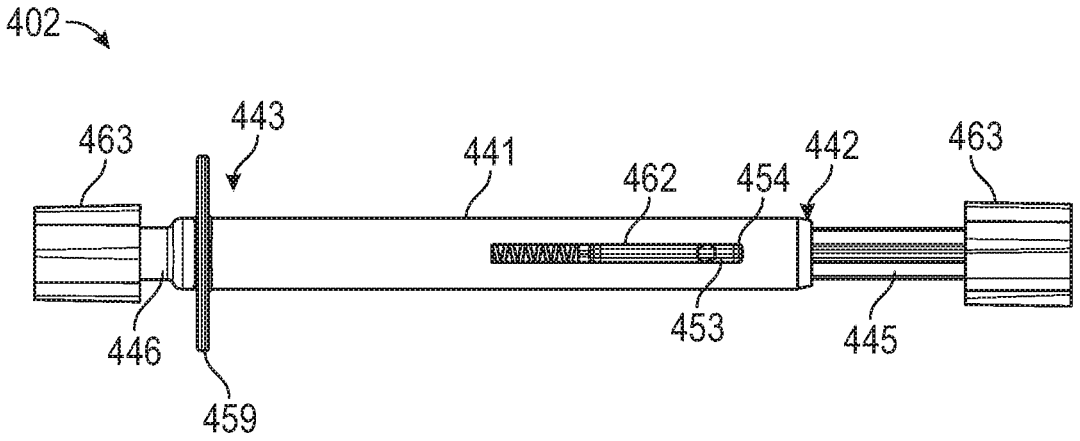
FIG. 9A is a plan view of yet another embodiment of a sheet product spindle.
Figure 9B:
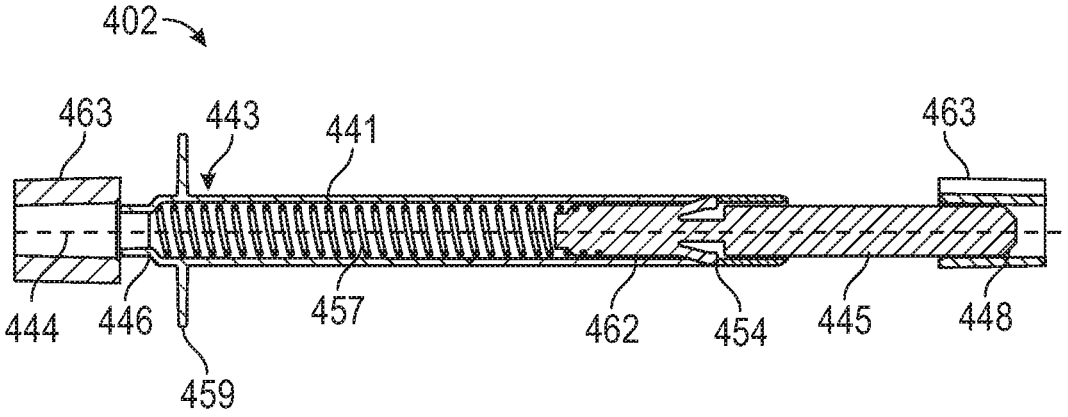
FIG. 9B is a cross-sectional view of the sheet product spindle shown in FIG. 9A.
Figure 9C:
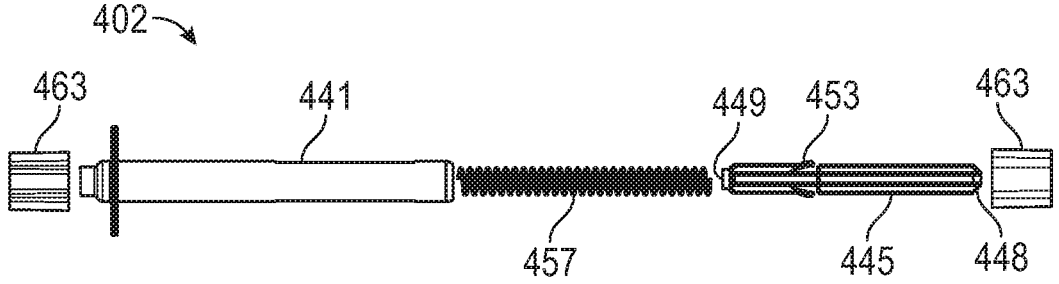
FIG. 9C is an exploded view of the sheet product spindle shown in FIG. 9A.

FIGS. 9A-9C illustrate still another embodiment of a sheet product spindle 402. The spindle 402 is also configured for use with a coreless sheet product roll and suitable for use with various cover assemblies, such as the cover assembly 104, to dispense the sheet product.

The sheet product spindle 402 includes a body 441 with a first end 442 and a second end 443. The body 441 includes a hollow shaft that receives a rod 445 and a compression spring 457. An end piece 446 and a disk 459 are integrally formed with the body 441. For instance, these features may be a single molded polymer structure. The disk 459 may extend radially from the second end 443 of the body 441. The rod 445 is configured to translate telescopically within the hollow opening of the body 441, along the lateral axis 444. The first end 442 has an opening through which the rod 445 extends. The rod 445 includes a mounting end 448 and an opposed spring-facing end 449. The mounting end 448 of the rod 445 and the end piece 446 each include an adaptor plug 463 configured to engage the bearings of the cover assemblies described herein, such as the bearing 130 of the cover assembly 104.

As shown in FIG. 9A, the body 441 includes an elongated slot 462 in which a tab, or catch, 453 can translate. Only a single slot is visible, but an identical one is positioned on the opposed side of the body. As shown in FIGS. 9B and 9C, the rod 445 includes a pair of the catches 453 extending on opposites of the rod 445. The catches 453 are shaped and dimensioned to permit spindle assembly by insertion of the rod 445 into the hollow opening at first end 442 of the body 441, after inserting the compression spring 457, where the insertion causes the catches 453 to snap or lock into the slots 462. The catches 253 then are able to limit telescopic extension of the rod 445 from the body 441 and keeping the rod 445 from falling out the body 441. That is, when the catch 453 abuts the slot end 454 near first end 442, then lateral translation of the rod out of the body is stopped.

The mounting end 448 may facilitate insertion of the rod 445, and thus the spindle 402, into a central opening of a coreless roll of sheet product, and it may also ease removal of the coreless roll from the spindle 402 if necessary, as described above.

In some embodiments, the rod 445 is a molded polymeric material. For example, the rod 445 may be formed of polyethylene terephthalate, polyethylene, polyvinyl chloride, polypropylene, polystyrene, polylactic acid, polycarbonate, acrylic, acetal, nylon, or acrylonitrile butadiene styrene. In some other embodiments, the rod 445 is formed of a metal or metal alloy, such as aluminum or steel.

The disc 459 may be circular as shown or any other suitable shape. The disc 459 may include an elastomeric surface on the surface facing the body 441. The disc 459 may include a colored ring or similar indicator to indicate when the sheet product roll is substantially depleted and in need of replacement.

In use, a sheet product roll is disposed around the rod 445 and the body 441, between end piece 446 and the mounting end 448. The body 441, the rod 445, and the sheet product roll rotate together along the lateral axis 444. In a particular embodiment, the sheet product roll is a coreless roll of bath tissue.

In some embodiments, the mounting end 448 of rod 445 fits into an aperture, with adaptor 463, of a roll holder arm (which may be part of a cover assembly) and the end piece 446, with another adaptor 463, fits another aperture of another roll holder arm (which may be part of a cover assembly). The spindle 402 may be loaded into the roll holder by axially depressing rod 445 into the body 441, compressing the spring 457, and then releasing the rod once the ends 446 and 348, with adaptors, are aligned with the apertures in the arms.

In yet another embodiment, the spindle includes a hollow cylindrical body; a rod which extends partially out of the first end of the body; a spring disposed within the hollow cylindrical body and having one end in biasing contact with the end of the rod disposed within the body; and a friction hub disposed around the hollow cylindrical body between ends of the body, the friction hub being rotatable around the body, wherein the rod is configured to translate within the hollow cylindrical body without being able to fall out of the body. The body may have at least one radial channel in the outer surface of the body and the friction hub may include at least one member engaged in the radial channel to limit axial translation of the friction hub relative to the body. The rod has a spring-facing end which may include an anchor that is configured to slide within channels in the inner surface of the body but cannot fall out of the first end of the body due to interference between at least one ledge of the anchor and at least one end wall of the channels.

For example, FIGS. 10A-10E illustrate a sheet product spindle 2102. The spindle 2102 is configured for use with a coreless sheet product roll and includes a "friction hub" which enables the roll to rotate even when the ends of the spindle are retained in a fixed (non-rotating) position in a dispenser assembly, between a pair of roll holder arms.

The sheet product spindle 2102 includes a body 2141 with a first end 2142 and a second end 2143. The body 2141 includes a hollow shaft that receives a compression spring 2157 and a rod 2145. The first end 2142 of the body 2141 has an opening through which the rod 2145 extends. The rod 2145 includes a mounting end 2148 and a spring-facing end 2149.

Figure 10A:
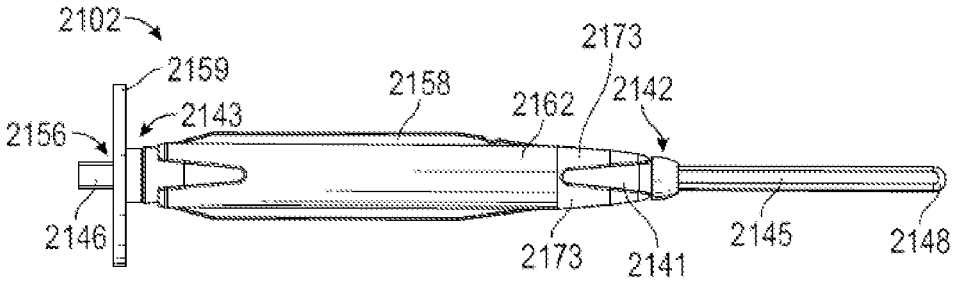
FIG. 10A is a plan view of another embodiment of a sheet product spindle.
Figure 10B:
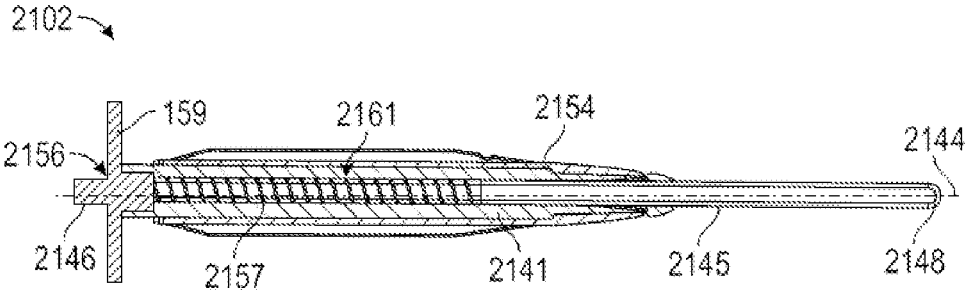
FIG. 10B is a cross-sectional view of the sheet product spindle shown in FIG. 10A.
Figure 10C:
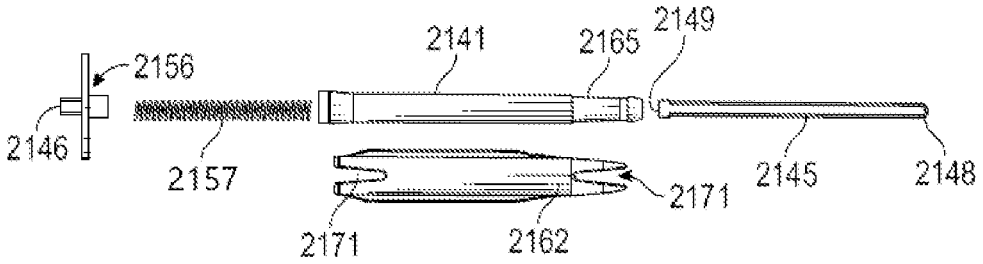
FIG. 10C is an exploded view of the sheet product spindle shown in FIG. 10A, showing the components of the spindle including a hollow body portion and a rod.
Figure 10D:
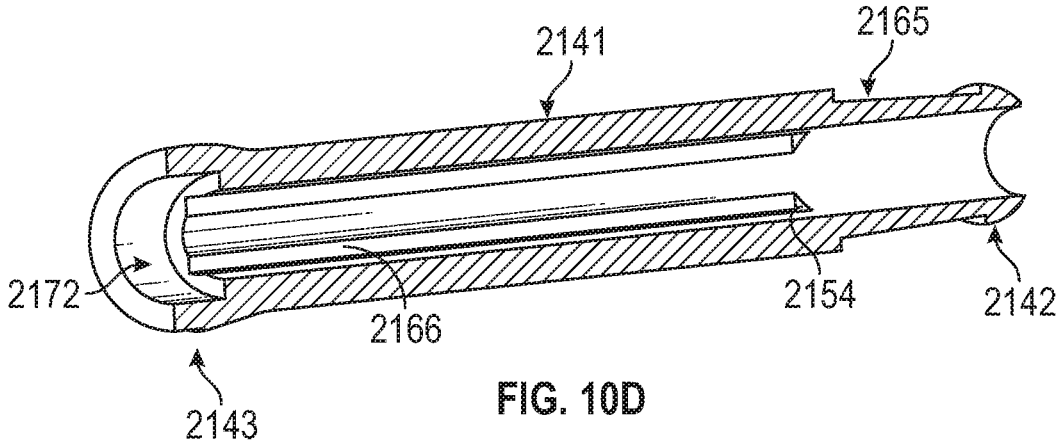
FIG. 10D is a perspective, cross-sectional view of part of the hollow body of the sheet product spindle shown in FIG. 10A.

A friction hub 2162 is rotatably disposed around the body 2141, between the first and second ends 2142 and 2143. The end portions of the friction hub 2162 each includes a pair of tapered cutouts 2171, such that each end of the friction hub include a so-called "duck bill." As shown in FIG. 10D, the body 2141 has a cylindrical outer surface with a recessed channel 2165 extending around the body 2141 near the first end 2142. The second end 2143 includes a taper, widening toward opening 2172. The tapered cutouts 2171 toward the first end 2142 of the body 2141 define flexible elongated members 2173 that fit into, and ride in, the recessed channel 2165, maintaining the lateral position of the friction hub on the body 2141.

The friction hub 2162 includes a pair of fins 2158 extending outwardly therefrom. In other embodiments, three, four, or more fins may be provided on the friction hub. The fins 2158 may extend (in the axial direction) along all or a portion of the length of the friction hub. The shapes, sizes, and numbers of the fins may vary; however, suitable configurations are adapted to frictionally engage with a coreless roll of tissue product when the spindle 2102 is inserted into the roll, thereby resisting spinning of the roll about the friction hub 2162.

The friction hub 2162 and a roll of sheet product mounted thereon will rotate together about the body 2141 and the rod 2145. The body 2141 and the rod 2145 are rotationally fixed with respect to one another; however, the rod 2145 is configured to translate telescopically within the hollow opening of the body 2141, along the lateral axis 2144.

The spindle 2102 further includes an end cap 2156 which is secured to the second end 2143 of the body 2141, closing off that end of the hollow shaft. The end cap 2156 includes an end piece 2146 and a disk 2159 extending radially from the end cap. The end piece and the disk may be integrally formed with the end cap. The disc 2159 may be circular as shown or any other suitable shape. The disc 2159 may include a colored ring or similar indicator to indicate when the sheet product roll is substantially depleted and in need of replacement, as described above. The mounting end 2148 and the end piece 2146 may have a non-cylindrical, e.g., square, cross-sectional shape so that it is configured to key or lock into an adaptor, or to engage the bearings of the cover assemblies described above. Alternatively, one or both of the mounting end 2148 and the end piece 2146 may be round, i.e., have a circular cross-sectional shape.

The spindle 2102 is assembled by inserting the rod 2145 and then the spring 2157 into an opening 2172 at the second end 2143 of the body 341, such that the mounting end 2148 of the rod extends out of the first end 2142 of the body 2141 and the spring 2157 and the spring-facing end 2149 of the rod being retained in the inner volume 2161 of the body 2141. Then the end cap 2156 is secured to second end 2143 of the body 2141 to close the opening and hold these components together. The end cap may be secured to the body by an adhesive or by snap-fit or frictional engagement, or the end cap and body may include mating threads and grooves to permit the two parts to be screwed together. Other mechanical attachment means are also envisioned. The friction hub can be mounted onto the body by sliding it over the first end of the body.

The mounting end 2148 may facilitate insertion of the rod 2145, and thus the spindle 2102, into a central opening of a coreless roll of sheet product, and it may also ease removal of the coreless roll from the spindle 302 if necessary, as described above.

In use, a sheet product roll is disposed around the rod 2145, the body 2141, and the friction hub 2162, between end piece 2146 and mounting end 2148. The friction hub 2162 may rotate (with the roll) about the rod 2145 and the body 2141, rotating along the lateral axis 2144. In a particular embodiment, the sheet product roll is a coreless roll of bath tissue.

Figure 10E:
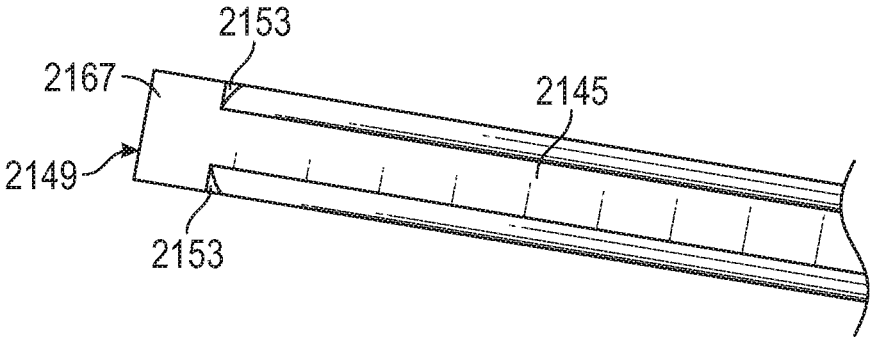
FIG. 10E is a perspective view of part of the rod of the sheet product spindle shown in FIG. 10A.

As shown in FIG. 10E, the spring-facing end 2149 of the rod 2145 includes a square shaped anchor 2167. The anchor 2167 includes four ledges, or catches 2153. In other embodiments, more or fewer catch features may be included. The corners of the anchor 2167 can translated within four mating channels 2166 in the inner surface of the body 2161, riding in the complementary shaped channels, until translation of the anchor 2167 is stopped at the end of the channels by channel end walls 2154. That is, the catches 2153 abut channel end walls 2154 when the rod 2145 is at its fully extended position from the body. The compression spring 2157 causes the catch 2153 to abut channel end wall 2154 in the absence of a compressive load.

In some embodiments, the rod 2145 is a molded polymeric material. For example, the rod 2145 may be formed of polyethylene terephthalate, polyethylene, polyvinyl chloride, polypropylene, polystyrene, polylactic acid, polycarbonate, acrylic, acetal, nylon, or acrylonitrile butadiene styrene. In some other embodiments, the rod 2145 is formed of a metal or metal alloy, such as aluminum or steel.

In some embodiments, the mounting end 2148 of rod 2145 fits into an aperture, with or without an adaptor, of a roll holder arm (which may be part of a cover assembly) and the end piece 2146 fits another aperture, with or without an adaptor, of another roll holder arm (which may be part of a cover assembly). The spindle 2102 may be loaded into the roll holder by axially depressing rod 2145 into the body 2141, compressing the spring 2157, and then releasing the rod once the ends 2146 and 2148 are aligned with the apertures in the arms.

Figure 11A:
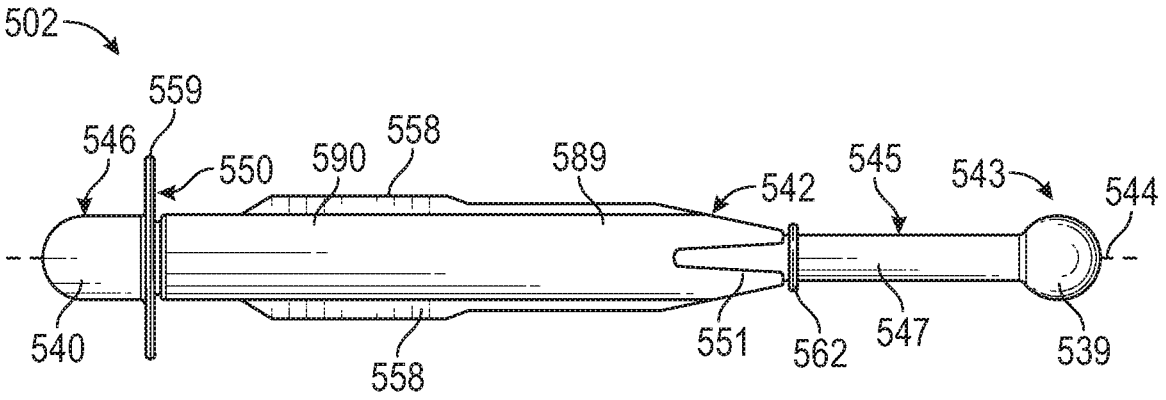
FIG. 11A is a plan view of another embodiment of a sheet product spindle, including a spherical end.

FIG. 11A shows another embodiment of a spindle 502 for a roll of sheet product. Spindle 502 is configured for use with a coreless sheet product roll (not shown). The spindle 502 is configured to allow a user to obtain a length of sheet product from a sheet product roll (e.g., as shown in FIG. 1B) by rotation of the roll with the spindle 502. The spindle is dimensioned to be fit into and engage with a central opening of a coreless sheet product roll. The spindle 502 may be configured to rotate about a lateral axis 544 to dispense the sheet product.

The sheet product spindle 502 includes a rod 545, a hollow shaft 589 (also referred to herein as a body), and an end piece 546. The rod 545 is configured to translate telescopically within the hollow opening of the hollow shaft 589, along the lateral axis 544. The hollow shaft 589 has a first end 542 having an opening through which the rod 545 extends. As shown in FIG. 11A, the rod 545 includes a spherical end 539 at a second end 543. The spherical end 539 may be integral with the cylindrical body portion 547, or it may be a separately formed component fixed, or rotatably mounted, to the cylindrical body portion 547 of rod 545. The spherical end may function as a ball joint as described below with reference to FIG. 11B.

The spherical end 539 advantageously may facilitate insertion of the rod 545, and thus the spindle 502, into a central opening of a coreless roll of sheet product, and it may also ease removal of the coreless roll from the spindle 502 if necessary. Insertion can be difficult because coreless tissue product rolls may be partially collapsed or deformed during shipping, storage, and handling, which can alter the roll geometry and therefore collapse or constrict the opening in the center of the roll. The spherical end can be pushed into such altered openings without damaging the roll, and without providing an edge that can snag the roll when removing a roll or partial roll from the spindle.

In use, a sheet product roll is disposed around the rod 545 and the hollow shaft 589, between end piece 546 and spherical end 539. The hollow shaft 589 may rotate about the rod 545, rotating along the lateral axis 544. In some preferred embodiments, the sheet product roll is a coreless sheet product roll, particularly a roll of bath tissue.

As shown in FIG. 11A, the rod 545 includes ring 562, which is shown in a (partially unassembled) position before the rod 545 is slid axially into the hollow shaft 589. Once inside the hollow shaft, the ring 562 serves to provide lateral surface(s) to abut an end of a spring and/or to abut an interior lateral surface in the hollow shaft 589, as detailed below in FIG. 14. The first end 542 of hollow shaft 589 is tapered and includes a series of cutouts 551, which facilitate elastic deformation of the first end 542 effective to permit the ring 562 to be inserted into the hollow shaft 589. In addition, the series of cutouts 551 provides a plurality of flaps that through a pre-stressed molded condition may locally compress against the rod 545 for the purpose of modifying pull force and thereby reducing usage and waste of the sheet product.

In some embodiments, the rod 545 is a molded polymeric material. For example, the rod 545 may be formed of polyethylene terephthalate, polyethylene, polyvinyl chloride, polypropylene, polystyrene, polylactic acid, polycarbonate, acrylic, acetal, nylon, or acrylonitrile butadiene styrene. In some other embodiments, the rod 545 is formed of a metal or metal alloy, such as aluminum or steel.

As shown in FIG. 11A, the hollow shaft 589 includes a pair of fins 558 extending outward from cylindrical body portion 590. In other embodiments, three, four, or more fins may be provided on the hollow shaft. The fins 558 may extend (in the axial direction) along all or a portion of the length of the cylindrical body portion. The shapes, sizes, and numbers of the fins may vary; however, suitable configurations are adapted to frictionally engage with a coreless roll of tissue product when the spindle 502 is inserted into the roll, thereby resisting spinning of the roll about the hollow shaft 589.

As shown in FIG. 11A, the hollow shaft 589 is coupled to end piece 546. These two components may be coupled rotatably to one another, e.g., to permit the hollow shaft 589 (and tissue product roll) to rotate about the lateral axis 544. End piece 546 includes a tangential ball end 540 and a disc 559. The disc 559 may be circular as shown or any other suitable shape. The disc 559 may include an elastomeric surface 550 on the surface facing the hollow shaft 589. When the end piece 546 is engaged with a roll holder arm in a manner that negates or resist rotational motion of the end piece, then the elastomeric surface in contact with a side of a roll of sheet product may act as a braking element to modify or increase pull force and thereby beneficially reduce tissue usage. In some embodiments, the elastomeric surface 550 of the disc 559 may include a colored (e.g., a bright or contrasting color) ring or other visual indicator to indicate when the sheet product roll is substantially depleted and in need of replacement.

In some embodiments, the tangential ball end 540 fits into a hole of first arm of a roll holder, and the spherical end 539 fits into an opposed hole in a second arm of the roll holder, following loading of a roll of sheet product onto the spindle 502. The spindle 502 may be loaded into the roll holder by axially depressing rod 545 into hollow shaft 589, compressing a spring therein, and then releasing the rod once the ends 540, 543 are aligned with the holes.

Figure 11B:
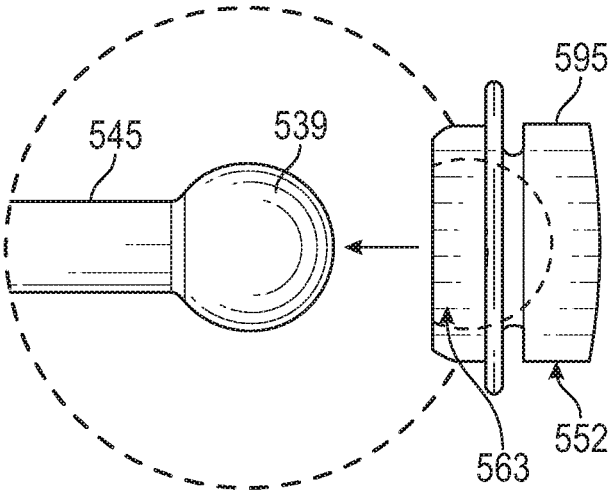
FIG. 11B is a close-up of the spherical end of the sheet product spindle shown in FIG. 11, and an embodiment of an adaptor in which the spherical end may be secured.

FIG. 11B shows a part of the rod 545 with spherical end 539 of spindle 502 and an adaptor 595. The adaptor 595 includes a cavity 563 for receiving the spherical end 539 and a groove 552 for securing the adaptor into a slot of an arm holder that has a slot instead of a hole for receiving a spindle. The cavity 563 may have a partial spherical shape dimensioned to cooperate with the spherical end 539 as a ball joint. The adaptor 595 may be elastomeric to permit the spherical end 539 to be "snapped" into the cavity 563, rotatably securing the adaptor 595 to the rod 545. This snap coupling is reversible to permit installation of a new roll of sheet product.

Figure 12:
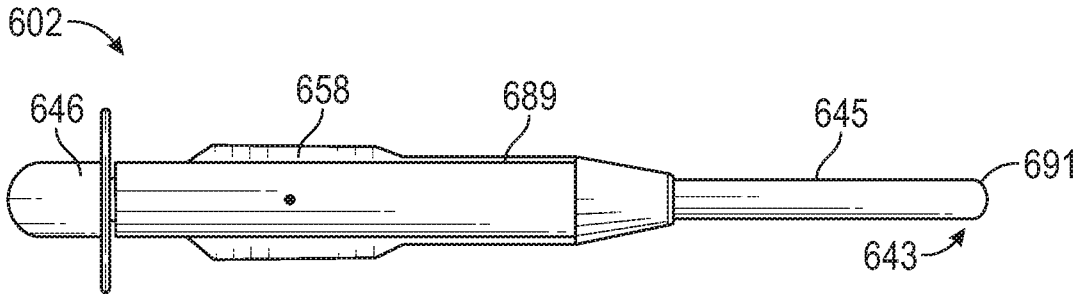
FIG. 12 is a plan view of still another embodiment of a sheet product spindle, including an end piece.

Another embodiment of a sheet product spindle 602 is shown in FIG. 12. Spindle 602 is similar to sheet product spindle 502; however, the second end 643 of the rod 645 includes a tangential ball end 691 to assist with insertion into a coreless roll of sheet product. Spindle 602 also includes end piece 646 and hollow shaft 689 with fins 658, which may be similar or identical to those components described with respect to spindle 502. In some embodiments, the ends 643 and 646 are equal in size to facilitate ease of either left hand or right hand insertion of the loaded spindle into a roll holder arm. In a preferred embodiment, rod 645 is formed of a metal, which beneficially may provide enhanced durability, and may be provided with a polished finish for enhancing the appearance of the spindle.

Figure 13:
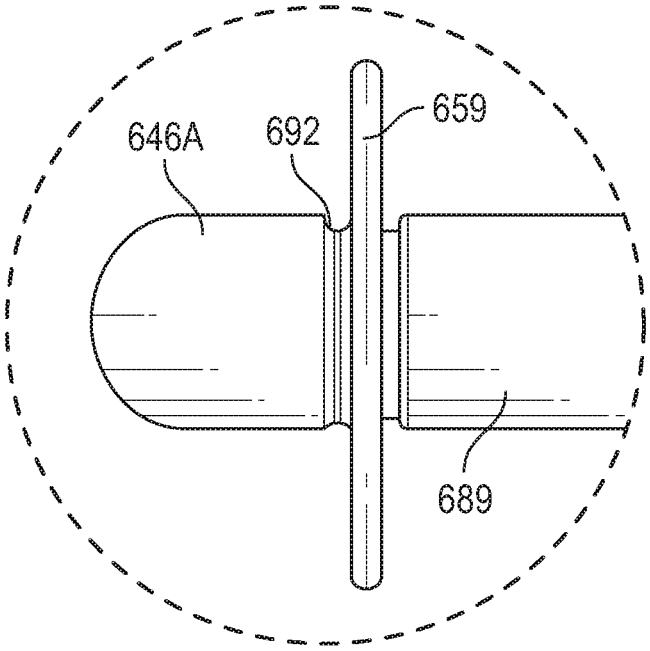
FIG. 13 is a close-up of an alternative embodiment of the end piece of the sheet product spindle shown in FIG. 12.

FIG. 13 shows an alternative end piece 646*a* of a spindle, which includes a hollow shaft 689. The end piece 646*a* is similar to end piece 646 described above, but includes a groove 692. End pieces 646 and 646*a* each include a disc 659. The groove 692 is configured for securing the end piece 646*a* into a slot of an arm holder that has a slot instead of a hole for receiving a spindle end. In this way, the spindle including end piece 646*a* may be suitable for use with a variety of styles of roll holder arms.

Figure 14:
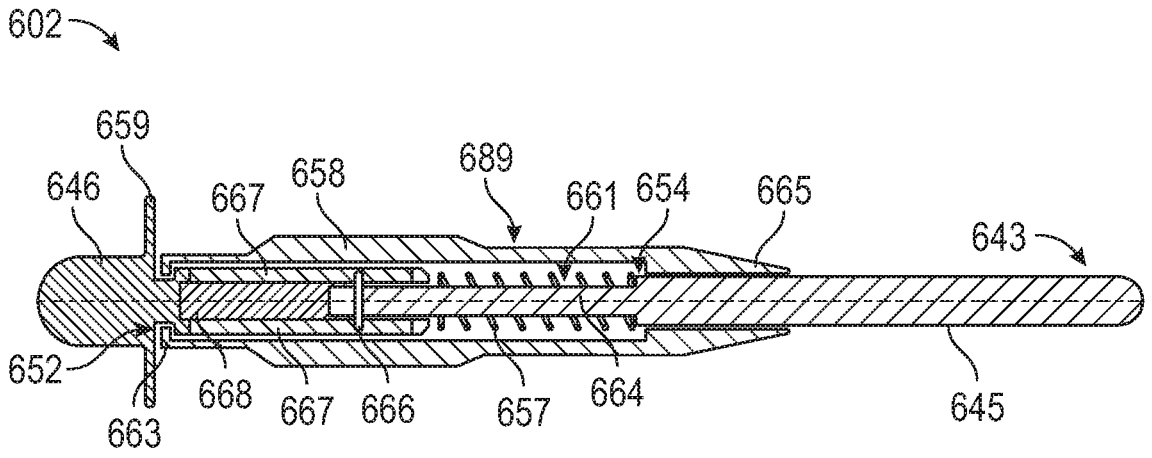
FIG. 14 is a cross-sectional view of another embodiment of a sheet product spindle.

FIG. 14 shows sheet product spindle 602. Spindle 602 includes hollow shaft 689, which includes an internal volume 661 for receiving narrow portion 664 of rod 645 and for containing a spring 657 configured to bias rod 645 away from end piece 646. The spring 657 shown is a helical spring, although other types of springs may be used. One end of the spring 657 engages against ledge 654 of the rod 645. The opposing end of the spring 657 engages against the end of an annular portion 667 of the end piece 646 located within the internal volume 661. Spindle 502 may have a similar internal volume and spring in hollow shaft 589, with that spring engaging against ring 562.

The hollow shaft 689 also includes a pair of internal fins 665 as shown in FIG. 14. In other embodiments, three, four, or more internal fins may be provided. The internal fins 665 may serve to modify or increase pull force on the rod 645 as the hollow shaft rotates about the rod, which may desirably reduce overspinning and wasteful dispensing of sheet product.

FIG. 14 also shows that end piece 646 includes an annular portion, which extends into the hollow shaft 689. The annular portion 667 includes an annulus 668 for receiving the narrow portion 664 of rod 645. That is, at least part of the narrow portion 664 translates within and into the annulus 668 when the rod moves to compress the spring 657. As illustrated, a drive pin 666 is included to secure the narrow portion 664 of rod 645 together with annular portion 667 of end piece 646, permitting the translation of the former within the latter but preventing the complete separation of the two components, e.g., upon release of compression of the spring.

The end piece 646 also includes a groove 652 located between the disc 659 and the annular portion 667. The groove 652 is configured to receive a lip 663 of the hollow shaft 689. The groove 652 and the lip 663 cooperate to maintain the axial position of the hollow shaft 689 relative to the end piece 646, while permitting the hollow shaft 689 to rotate about the annular portion 667.

Figure 15:
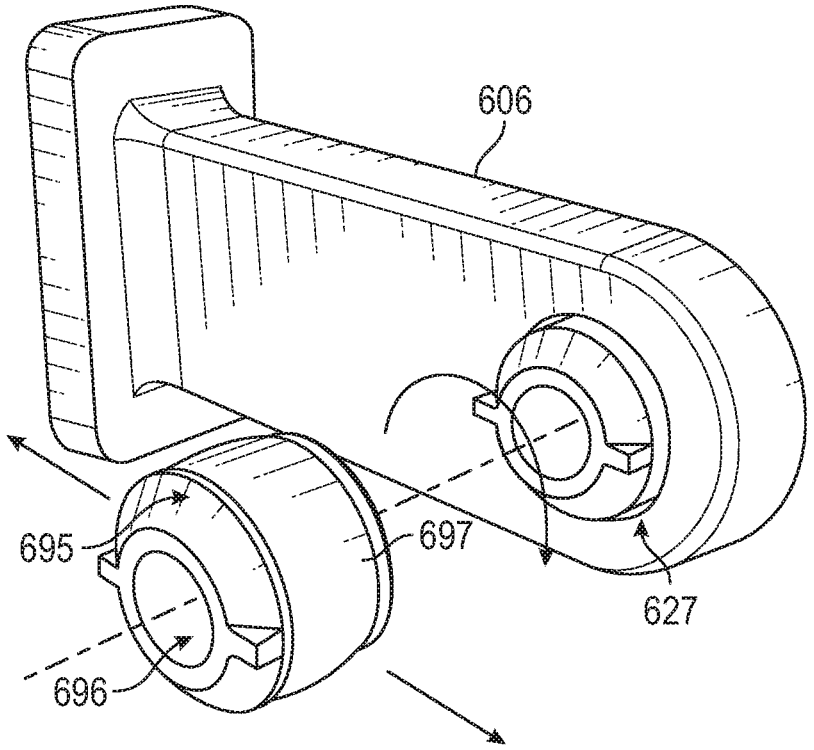
FIG. 15 is a perspective view of an embodiment of an adaptor and an arm of a sheet product roll holder, showing the adaptor both separate from and installed in the arm.

FIG. 15 shows an adaptor plug 695 and a conventional roll holder arm 606. The adaptor plug 695 is configured to fit within a recess 627 in the roll holder arm 606. Such conventional recesses may be too large to stably secure and accurately position at least some of the sheet product spindles described herein. The adaptor plug is provided to address this problem.

The adaptor plug 695 includes an aperture or cavity 696 which is dimensioned and positioned to receive and secure an end of a sheet product spindle, such as one of the spindles configured for use with a coreless sheet product roll as described hereinabove. The adaptor plug 695 also includes an expandable surface 697 configured to secure the adaptor plug 695 within the recess 627, e.g., by frictional engagement with interior sidewalls of the recess 627. For example, the adaptor plug may include two rigid structures that can be screwed together to radially displace an elastomeric material forming the expandable surface. In this way, the adaptor plug 695 may be inserted into the recess 627 with the elastomeric material in an unexpanded configuration and then rotating an accessible one of the rigid structures (relative to the other rigid structure) to expand the expandable surface, radially, into secure engagement with the interior wall of the recess 627.

Figure 16:
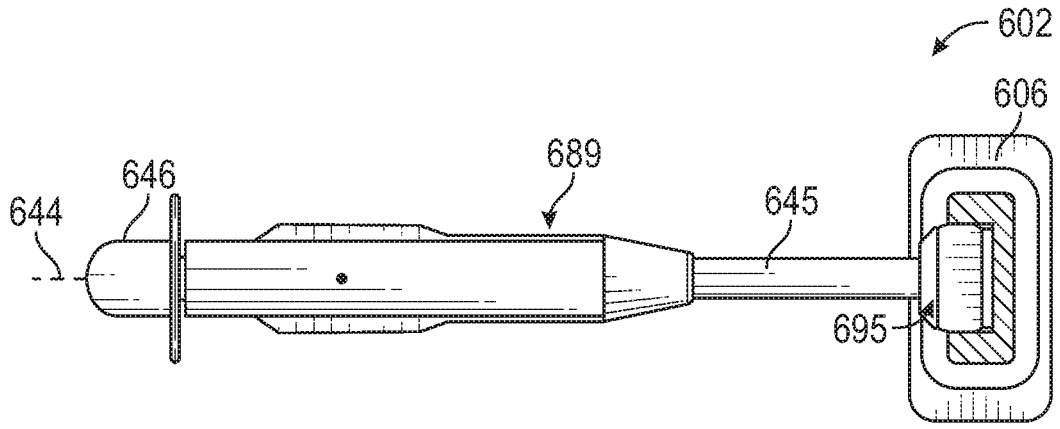
FIG. 16 is a cross-sectional view of the adaptor and arm shown in FIG. 15, with a sheet product spindle installed therein.

FIG. 16 shows spindle 602 in an installed position with rod 645 inserted into the adaptor plug 695 which is installed in roll holder arm 606. The end piece 646 of the spindle 602 will be secured in a second roll holder arm (not shown). In use, a coreless roll of sheet product (not shown) may be secured onto the hollow shaft 689, which may spin about the lateral axis 644 to dispense the sheet product.

Figure 17:
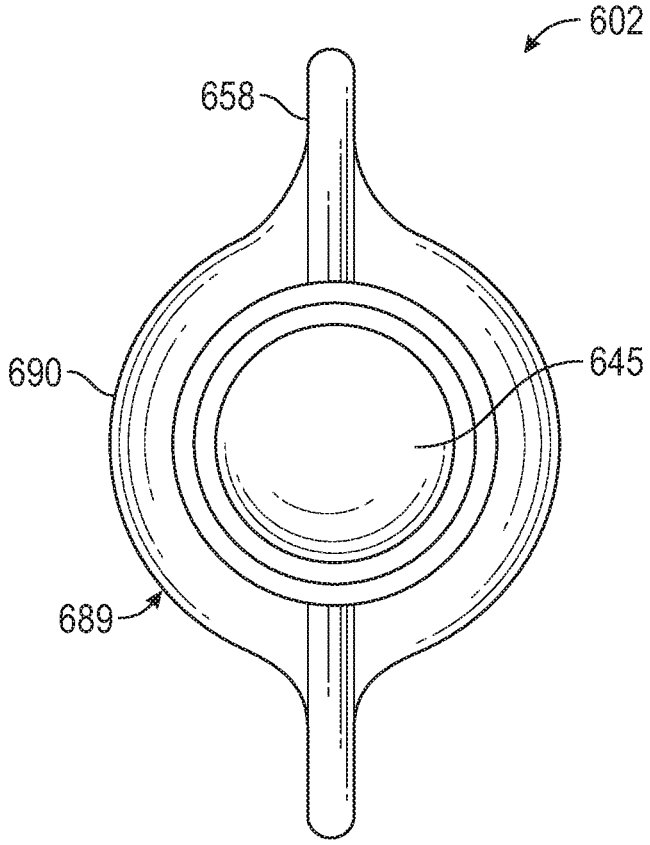
FIG. 17 is an end view of the sheet product spindle shown in FIG. 16.

FIG. 17 shows the hollow shaft 689 of spindle 602 together with rod 645. Two fins 658 extend from the cylindrical body portion 690 of the spindle 602.

Figure 18:
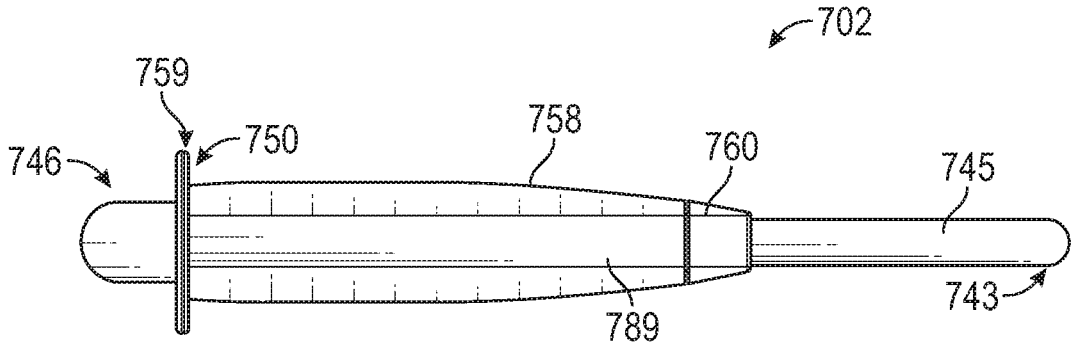
FIG. 18 is a plan view of another embodiment of a sheet product spindle, including an elastomeric ring.
Figure 19:
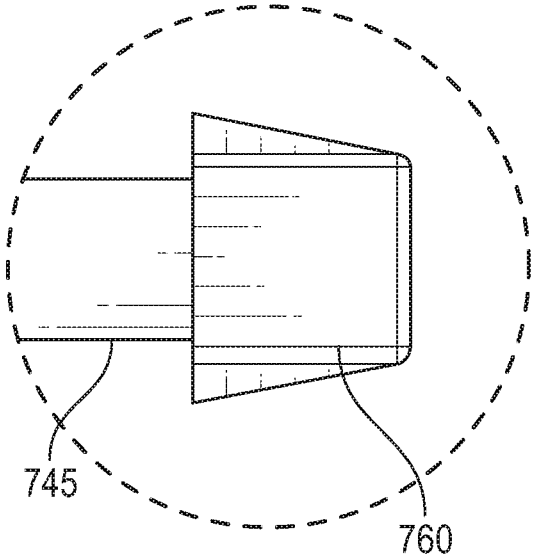
FIG. 19 is a close up view of the elastomeric ring shown in FIG. 18 slid to the end of the spindle rod.

FIG. 18 shows another embodiment of a sheet product spindle 702. The spindle 702 is similar to spindle 602 described above; however, the hollow shaft 789 has differently shaped fins 758. In addition, the spindle 702 includes an elastomeric ring 760 which is slidably axially about the rod 702 from a position abutting the hollow shaft 789, as shown in FIG. 18, to a position about the end 743 of the rod 745, as shown in FIG. 19. The elastomeric ring 760 is tapered and functions as an adaptor. That is, it is configured to be inserted into and fill an aperture of a roll holder arm, to secure the end of the spindle in the roll holder arm. The elastomeric ring may be formed from a variety of elastomers known in the art, including silicone, polyurethane, nylon, and polyethylene.

Spindle 702 also includes an end piece 746, which includes a disc 759, which has a colored, elastomeric surface 750. The coloring of the surface provides a visual indication a coreless roll of sheet product on the spindle is substantially depleted and in need of replacement. The elastomeric nature of the surface increases or modifies pull force of a roll to reduce tissue usage as described above and also to provide a higher quality tactile feel to the user pulling tissue product from the roll.

Figure 20:
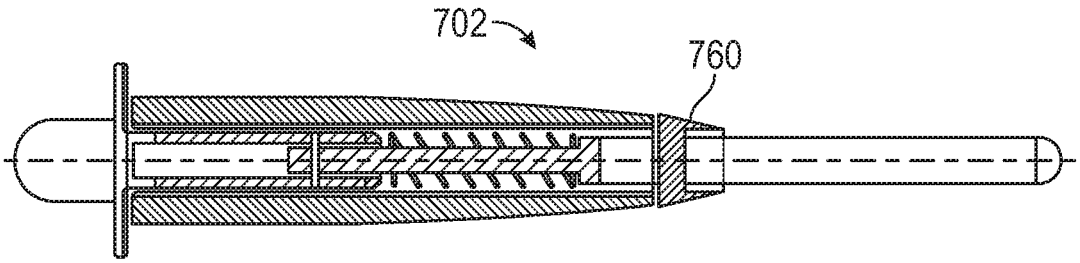
FIG. 20 is a cross-sectional view of a sheet product spindle shown in FIG. 18.
Figure 21:
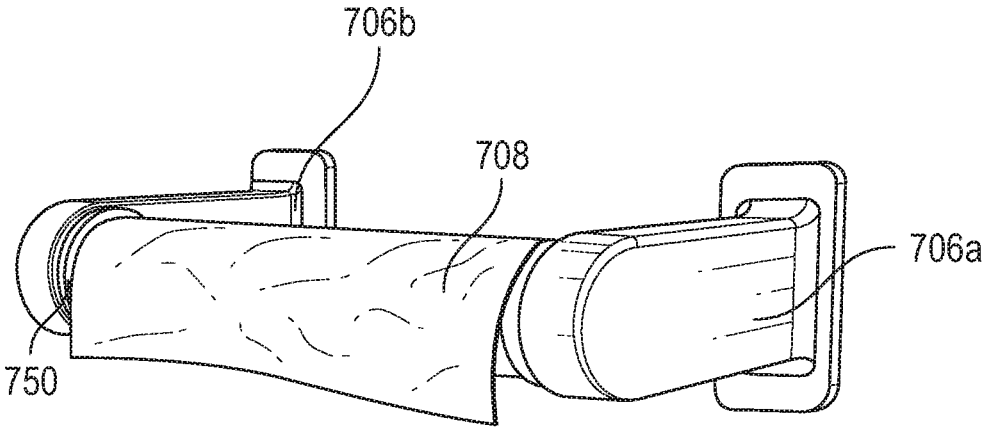
FIG. 21 is a perspective view of a partially depleted roll of sheet product installed on one embodiment of a sheet product spindle between a pair of roll holder arms.

FIG. 20 shows the internal configuration of sheet product spindle 702. Elastomeric ring 760 is shown in only partial cross-section. The elastomeric ring 760 may be provided in a differentiating color, so that (when the elastomeric ring is displaced to the end of the rod and serving as an adaptor to secure rod in a recess of a roller arm) the elastomeric ring may serve as a visual indicator. That is, the elastomeric ring may be obscured by a roll of sheet product until the roll is substantially depleted, and then it becomes visible once the sheet product of a coreless roll becomes substantially depleted. In this way, the elastomeric ring may indicate to a maintainer that roll of sheet product is in need of replacement. This is illustrated by example in FIG. 21, which shows sheet product spindle 702 installed between roll holder arms 706*a*, 706*b*. Because the roll of bath tissue 708 is substantially depleted, colored indicator surface 750 is visible, indicating that the roll of bath tissue should be replaced.

Figure 22:
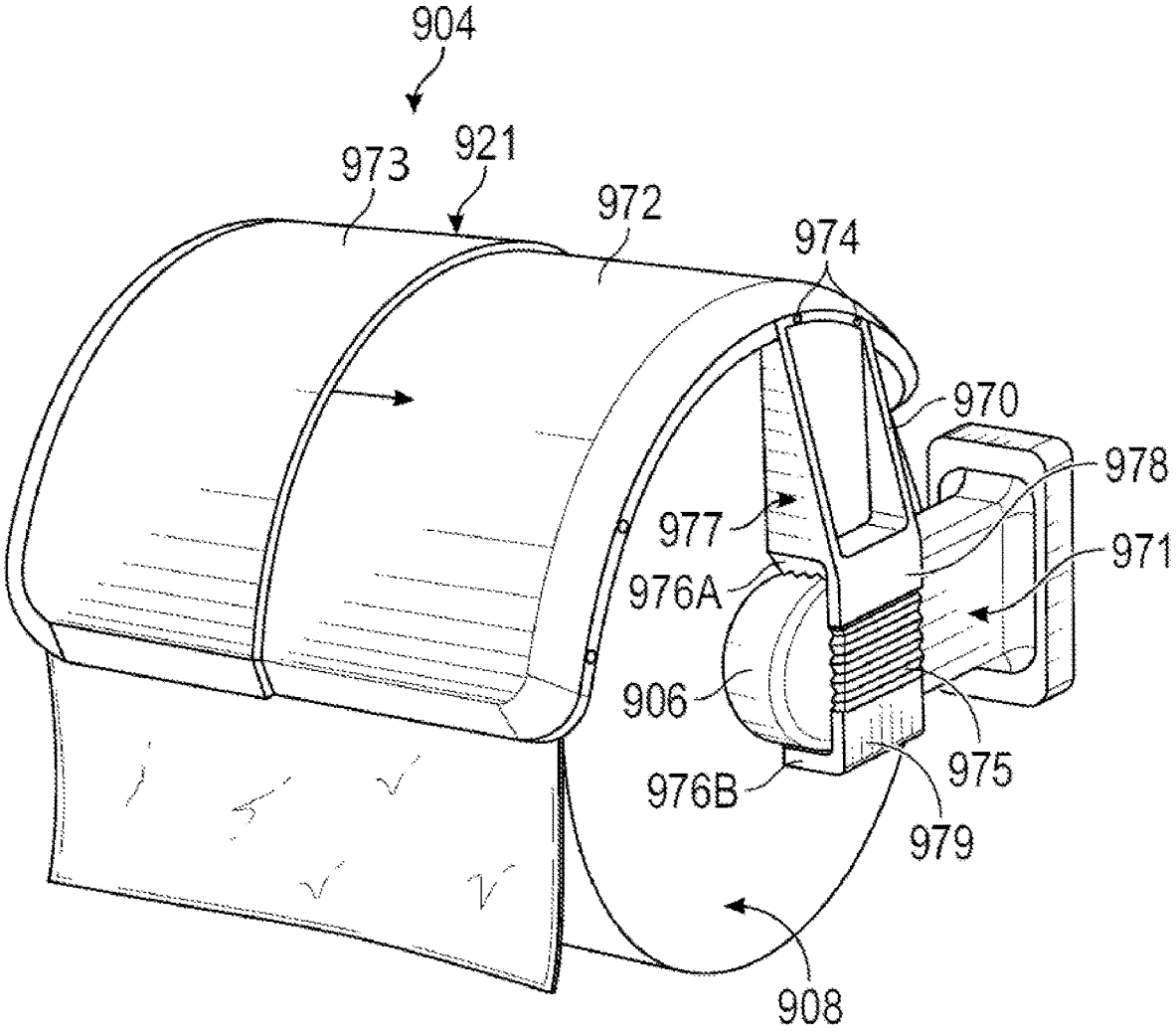
FIG. 22 is a perspective view of one embodiment of a sheet product dispenser cover assembly, including a clamping portion secured to a roll holder arm.
Figure 23:
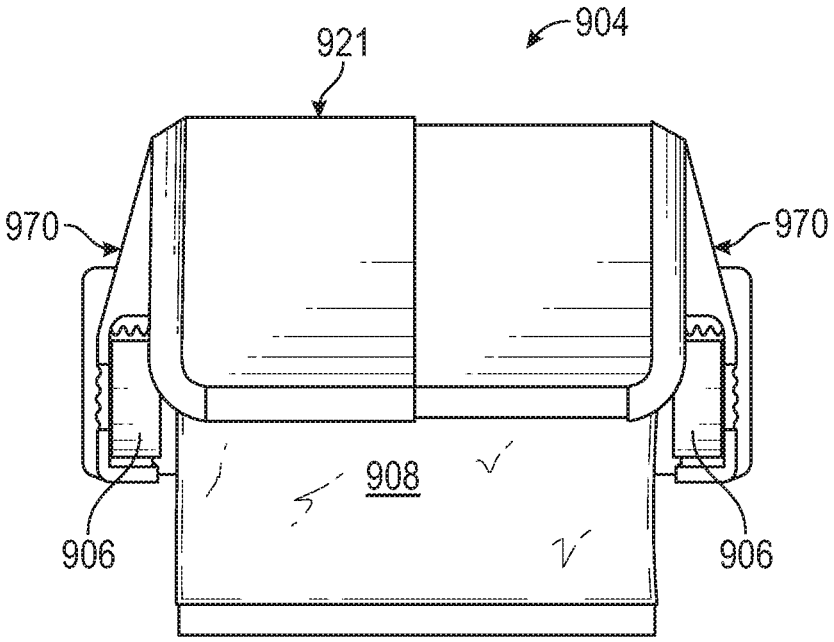
FIG. 23 is a front view of the sheet product dispenser cover assembly shown in FIG. 22.

FIGS. 22-23 show a cover assembly 904, which includes a cover 921 and adjustable support arms 970. The cover assembly 904 is configured to protect a sheet product roll 908. The cover assembly 904 is adjustable to accommodate a range of dimensions and shapes of roll holder arms.

The cover 921 includes a first cover part 972 and a second cover part 973. The first and second cover parts 972, 973 are configured to slide telescopically with respect to one another to adjust to fit the cover assembly 904 to various spacing lengths between roll holder arms across a range of conventional roll holder configurations. In some embodiments, the cover parts are secured together with cooperating grooves and rails or other structural elements known in the art.

The first and second cover parts 972, 973 are arcuate to cover a substantial portion of a roll of sheet product, e.g., over the top and front portion of the roll. For example, the cover may extend over from about 25% to about 60% of the side of the roll. The cover advantageously shields the roll from splashing liquids. The cover may also obscure the view of the sheet product roll to a user so that the user may be less likely to see the roll is partially depleted and thus previously "used" by others. A partially depleted roll may be perceived as less hygienic.

Each cover part may be integrally formed with, or fixedly connected to one of the support arms. Each cover part may be configured to mount to the support arm at different positions, for example to accommodate different orientations of mounted roll holders. In FIG. 22, the first cover part 972 includes two fastener positions 974 in which fasteners (e.g., screws) secure the first adjustable support arm 970 to the first cover part 972.

As shown in FIG. 22, the support arm 970 includes support portion 977 and a clamping portion 971. The support portion connects the cover to the clamping portion and spaces the cover away from a roll holder arm 906 to which the clamping portion is releasably secured. The clamping portion 971 includes a first L-shaped clamp member 978 and second L-shaped clamp member 979, which are configured to be positionally adjustable with respect to one another and thereby securable to a variety of sizes of roll holder arms. The clamp members are secured together and adjustable by a screw that extends between the clamp members. A rubber boot 975 covers the screw. The clamp members 978, 979 include gripping surfaces 976A, 976B, which may be textured (e.g., including ribs or teeth) or include a non-slip material surface, such as rubber or another elastomeric material.

Figure 24:
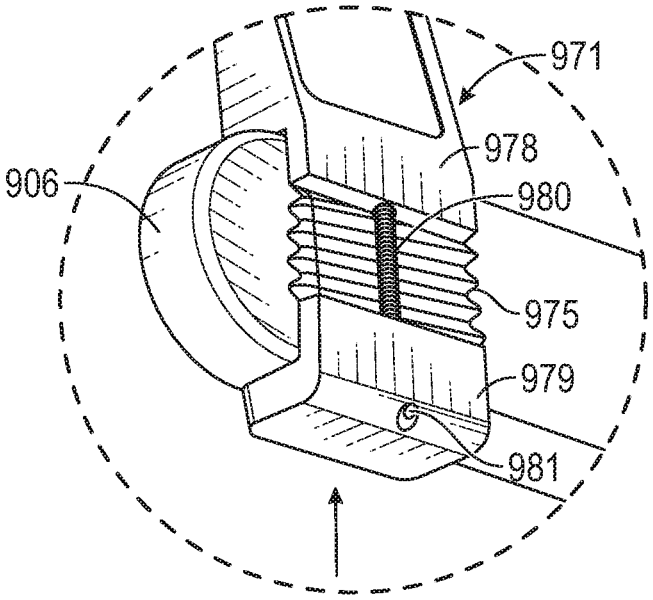
FIG. 24 is a close up, perspective review of one of the clamping portions and roll holder arms shown in FIG. 22 and FIG. 23.

FIG. 24 shows clamping portion 971 of the cover assembly 904 secured to roll holder arm 906. The roll holder arm 906 is sandwiched between clamp members 978, 979 which are pulled together by screw 980. The screw can be accessed via recess 981 in clamp member 979, and the screw 980 can be turned to adjust the spacing between the clamp members 978, 979 to accommodate various sizes of roll holder arms and to facilitate installation. Rubber boot 975 is illustrated in FIG. 24 to be transparent to show the screw, but would actually be opaque to hide the screw 980. In some embodiments, the clamping portion is sufficiently compliant to accommodate a wide range of non-ruled and/or tapered arm geometries. This compliant, or flexible, functionality of the clamping portion may be accomplished, for example, with the use of elastomeric materials of construction and/or with the use of pivotably or similarly partially constrained surfaces.

Figure 25:
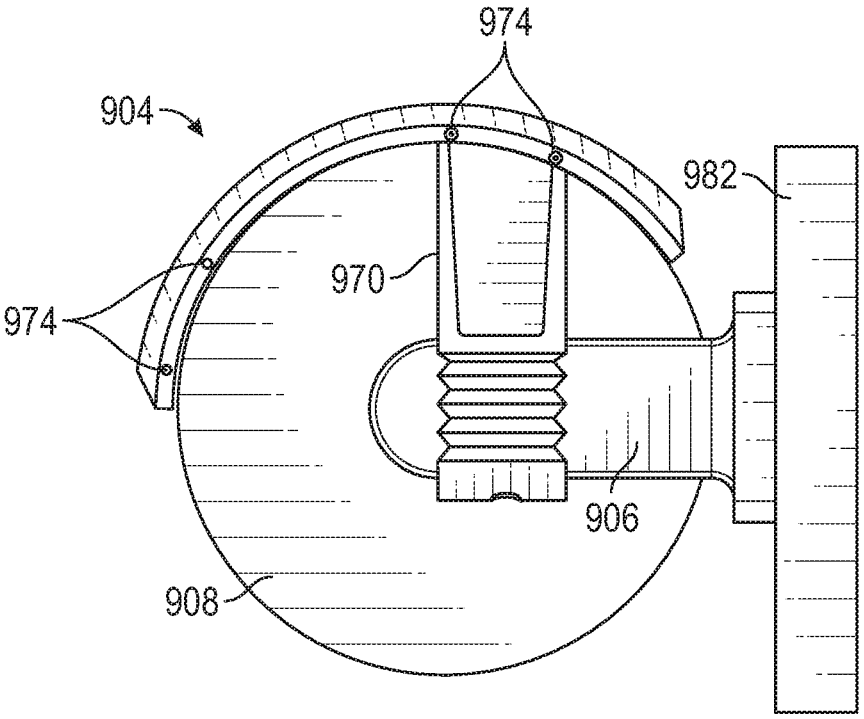
FIG. 25 is an end view of the sheet product dispenser cover assembly shown in FIG. 22, installed onto roll holder arms extending from a vertical surface.
Figure 26:
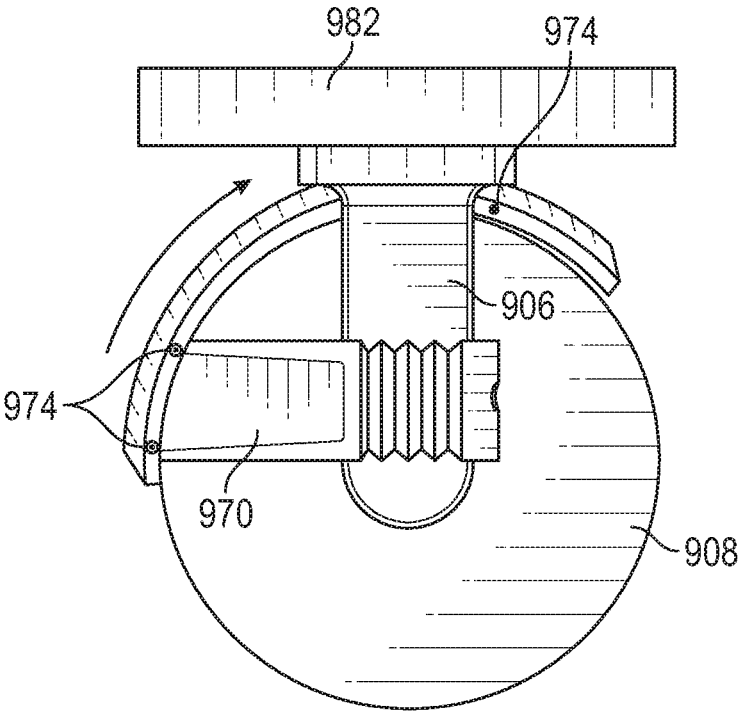
FIG. 26 is an end view of the sheet product dispenser cover assembly of FIG. 22, in an alternative assembly installed onto roll holder arms extending from a horizontal surface.

FIGS. 25-26 show two possible assembly configurations of the cover assembly 904, for accommodating different mounting orientations. FIG. 25 shows the cover assembly 904 having a configuration consistent with that shown in FIGS. 22 and 23, where roll holder arm 906 extends horizontally from vertical wall and where support arm 970 is secured to the cover at fastener positions 974. FIG. 26 shows an alternative assembly configuration in which roll holder arm 906 extends vertically downward from underneath a horizontal surface 982 and where support arm 970 is secured to the cover at fastener positions 974.

Figure 27:
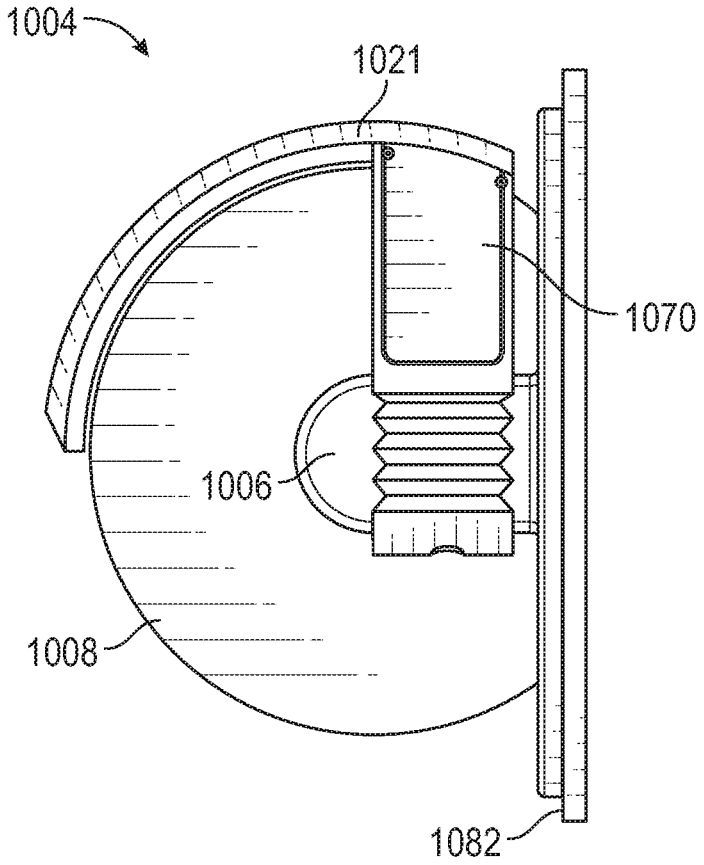
FIG. 27 is an end view of another embodiment of a sheet product dispenser cover assembly.

FIG. 27 shows another cover assembly 1004 mounted to an arm 1006 for dispensing sheet product from sheet product roll 1008. The tissue holder is recessed into wall 1082, and the support arms 1070 are mounted to roll holder arms 1006 close to wall, such that cover 1021 is connected to the support arms 1006 near an end edge of the cover. In this way, the back of the cover 1021 is flush with the back of the support arms 1070.

Figure 28:
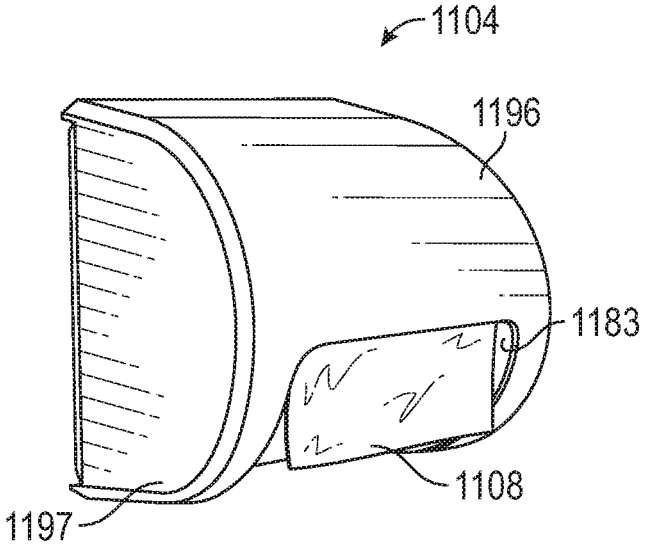
FIG. 28 is a perspective view of another embodiment of a sheet product dispenser cover.

FIG. 28 shows yet another cover assembly 1104. The cover assembly 1104 includes a front cover portion 1196 having an opening 1183 for accessing sheet product 1108. The cover assembly 1104 also includes end cover portions 1197, which cover the ends of the roll of sheet product. The front and end enclosures advantageously shield the roll from splashing liquids, providing a hygienic benefit. The front cover portion 1196 may be formed of a metal or alloy.

Figure 29:
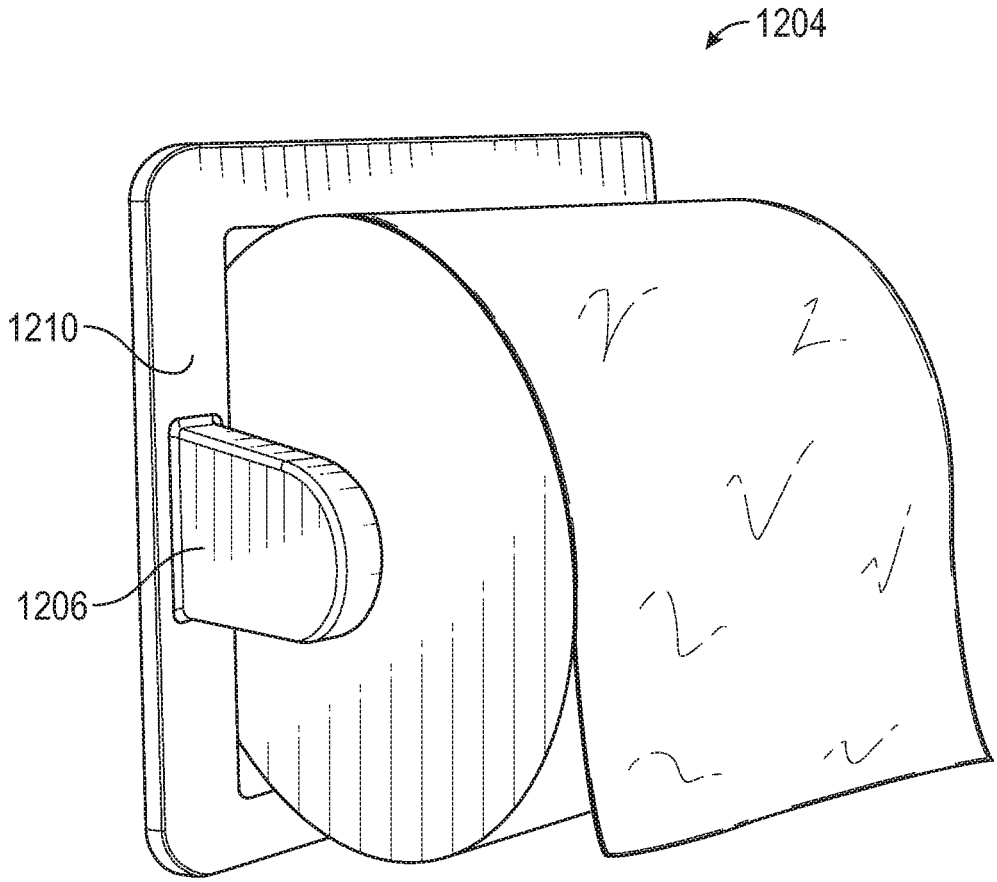
FIG. 29 (Prior Art)
FIG. 29 is a perspective view of a prior art sheet product dispenser.
Figure 30:
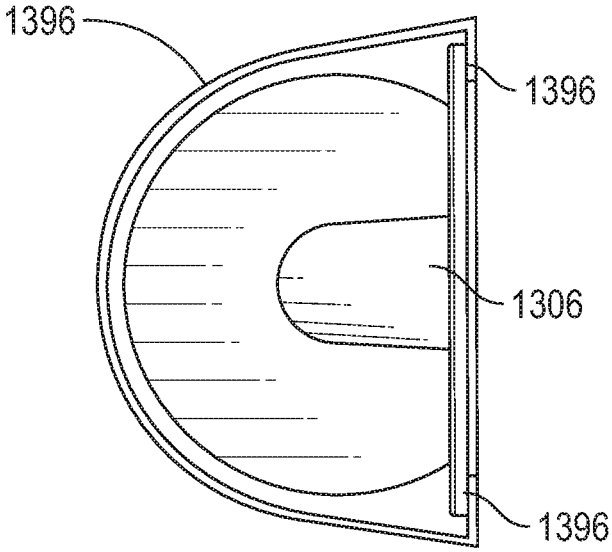
FIG. 30 is an end view of the sheet product dispenser shown in FIG. 29, with one embodiment of a sheet product dispenser cover (shown in cross-section) installed thereover.

FIG. 29 shows a conventional recessed tissue roll holder 1204 with which cover assembly 1104 may be used. The tissue roll holder 1204 includes a frame 1210 and roll holder arm 1206 extending from the frame 1210. FIG. 30 illustrates how the cover assembly 1104 is mounted to tissue holder 1204. The front cover portion includes top and bottom return edges 1396 which are configured to slide behind frame, so that the return edges 1396 are disposed between the frame of the tissue roll holder and the wall into which the tissue roll holder is installed. The end cover portion may include an opening to permit sliding installation of the return edges so that the end cover does not interfere with the frame or the roll arms 1306.

Figure 31:
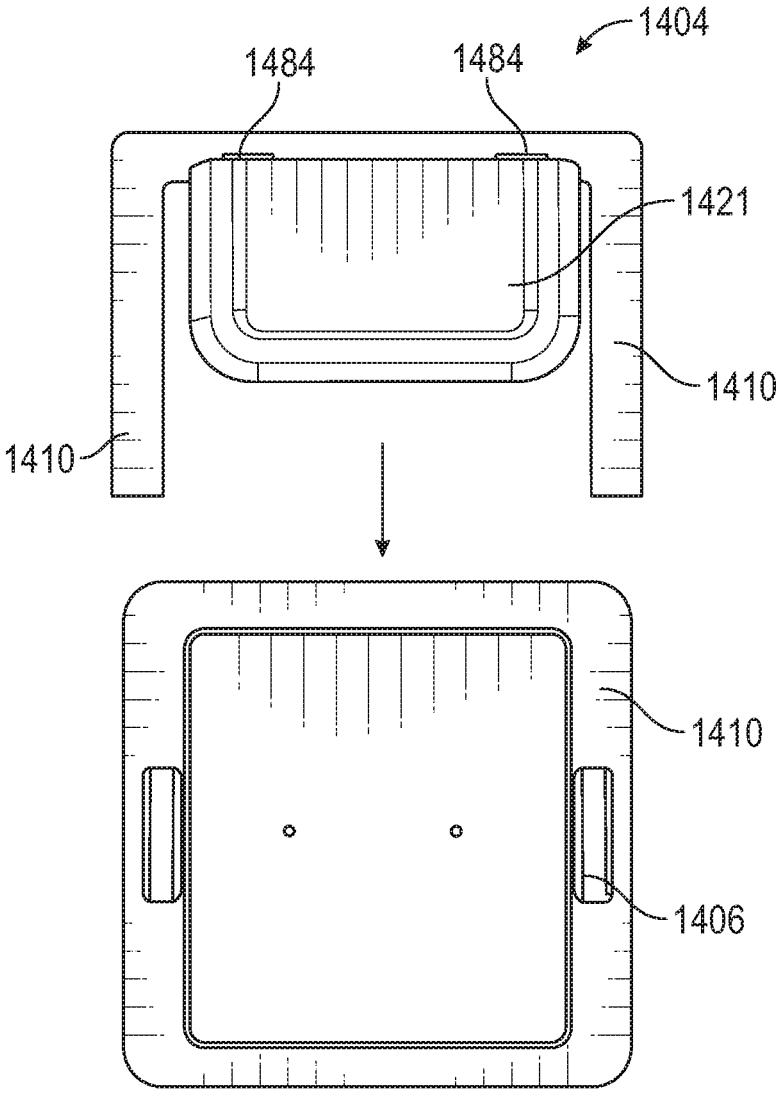
FIG. 31 is a front view of another embodiment of a cover assembly positioned for installation with the sheet product dispenser shown in FIG. 29.
Figure 32:
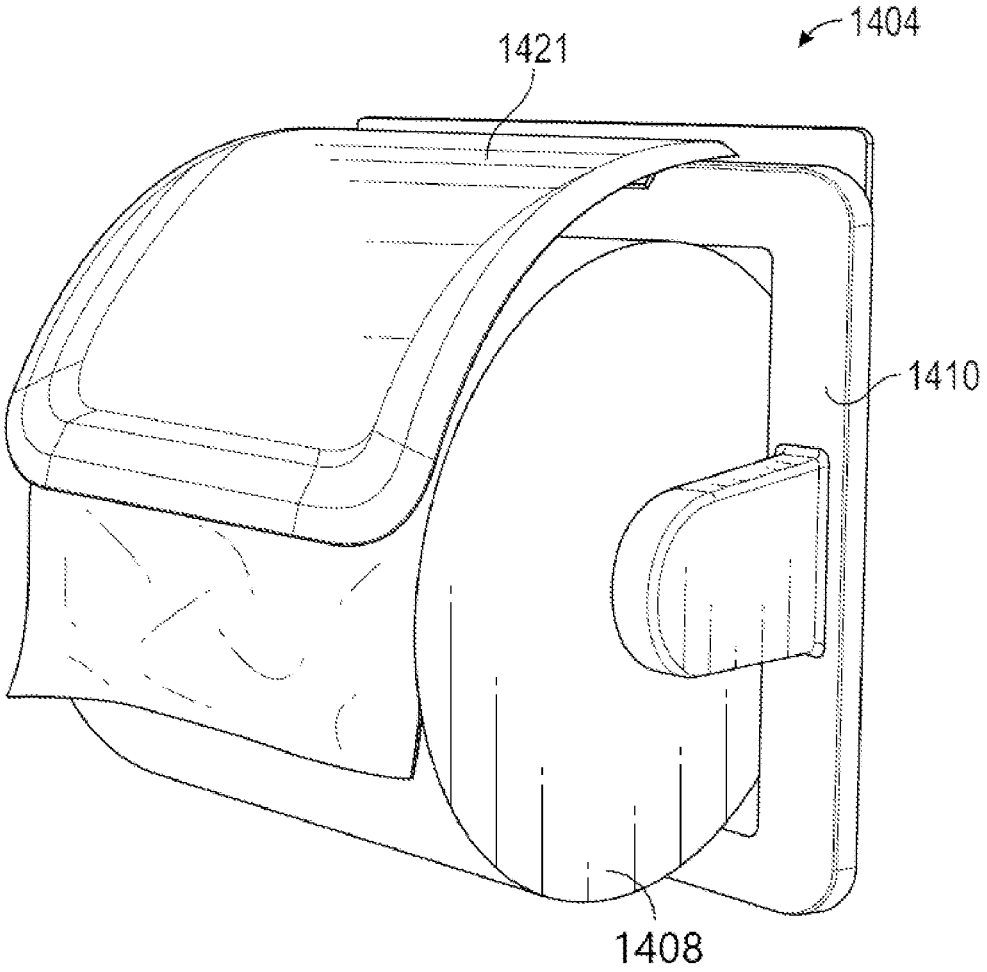
FIG. 32 is a perspective view of the cover assembly shown in FIG. 31 in an installed position with the sheet product dispenser shown in FIG. 29.

FIG. 31 shows another cover assembly 1404 positioned for installation onto a conventional tissue roll holder. The cover assembly includes U-shaped bracket 1410 (or mount) which is connected by hinges 1484 to cover 1421. The arms of the bracket 1410 are configured to slide behind the side edges of the frame of the tissue roll holder and arms 1406. As shown in perspective view in FIG. 32, the cover 1421 is curved and designed to rest against an installed roll of tissue 1408, beneficially shielding at least the top of the roll from splashing liquids and modifying a pull force on the roll during dispensing to impede overspin and wasteful dispensing of tissue.

Figure 33:
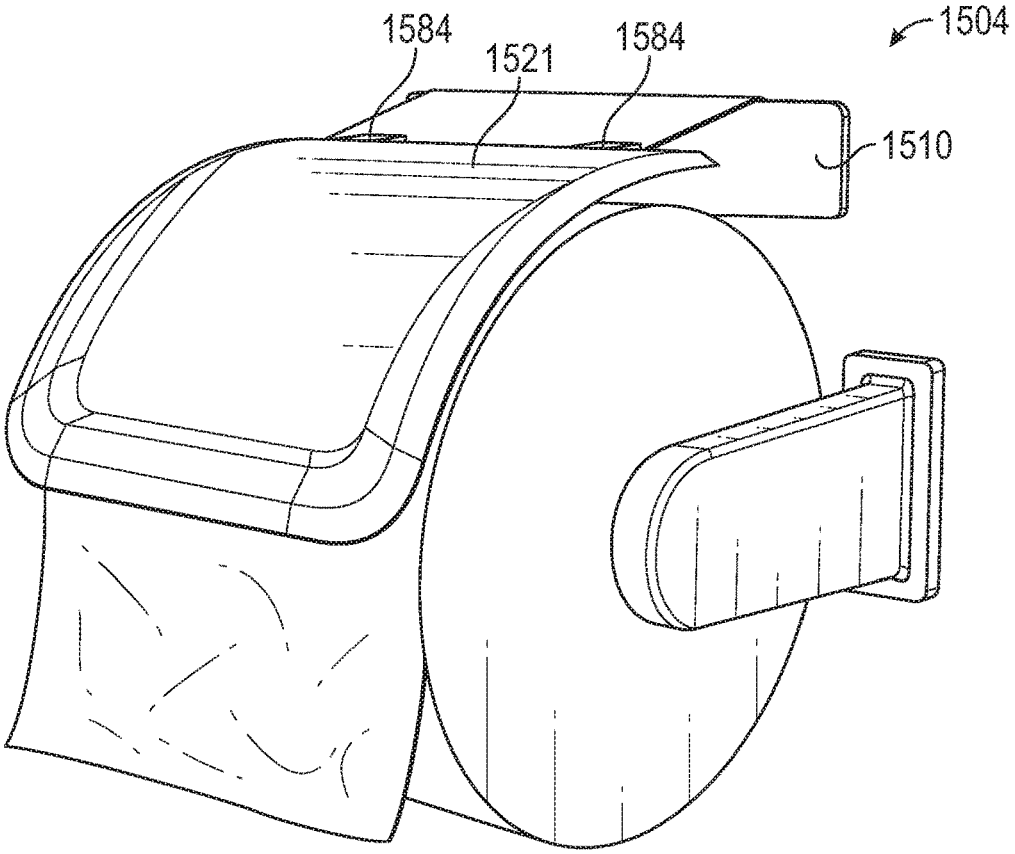
FIG. 33 is a perspective view of still another embodiment of a cover assembly installed over a conventional sheet product dispenser and roll.
Figure 34:
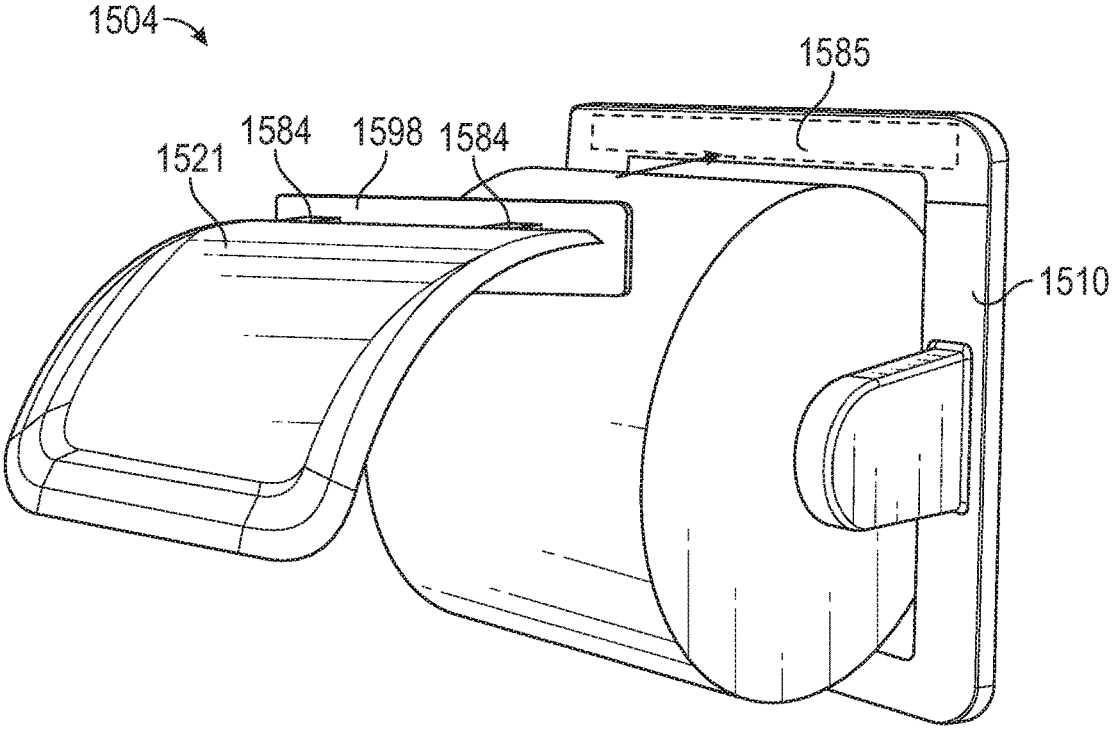
FIG. 34 is a perspective view of yet another embodiment of a cover assembly positioned for installation over another conventional sheet product dispenser and roll.
Figure 35:
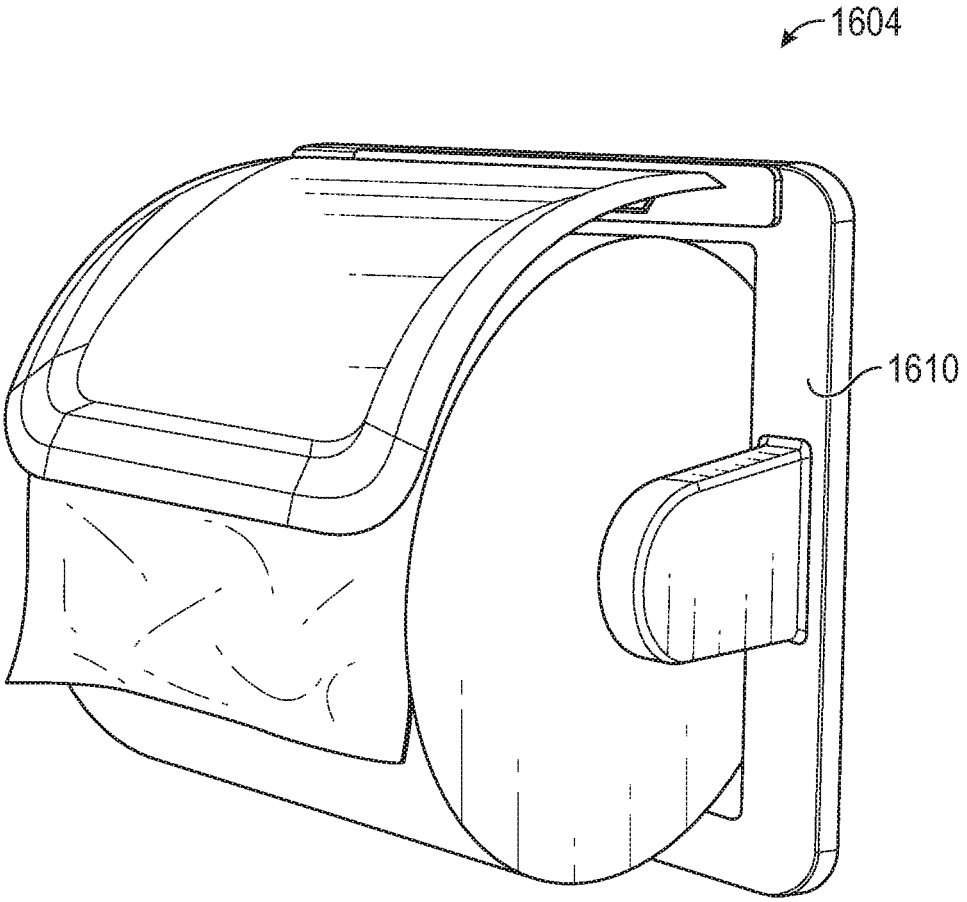
FIG. 35 is a perspective view of the cover assembly shown in FIG. 34 installed over the conventional sheet product dispenser and roll.

FIG. 33 shows another a cover assembly 1504. The cover assembly 1504 include cover 1521 which is connected by hinges 1584 to an angled bracket. Here, the cover assembly is shown mounted to a wall above a standard (non-recessed) tissue holder. The cover assembly can be mounted by any suitable means, including a double-sided adhesive tape. FIG. 34 shows how the cover assembly 1504 can be mounted to a recessed tissue holder 1510 (or mount). The cover assembly 1504 include cover 1521 which is connected by hinges 1584 to bracket 1598. Double sided adhesive 1585 is shown on the frame of the tissue holder 1510 which is to be adhered to back side of bracket. FIG. 35 shows the cover assembly 1604 installed on the tissue dispenser and mount 1610.

Figure 36:
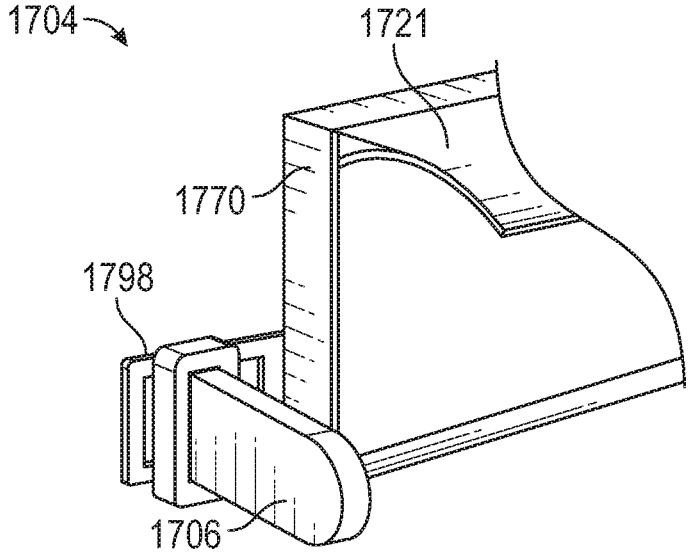
FIG. 36 is a partial, perspective view of another embodiment of a cover assembly.
Figure 37:
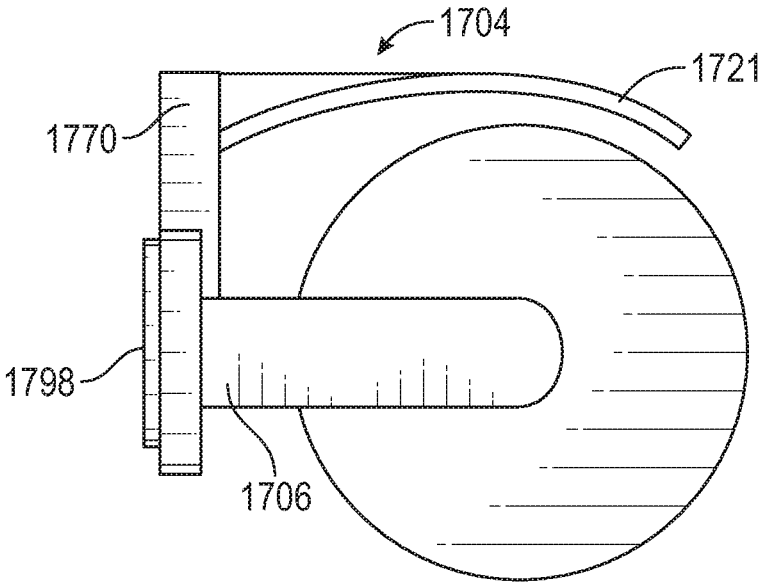
FIG. 37 is an end view of the cover assembly shown in FIG. 36 in an installed position.
Figure 38:
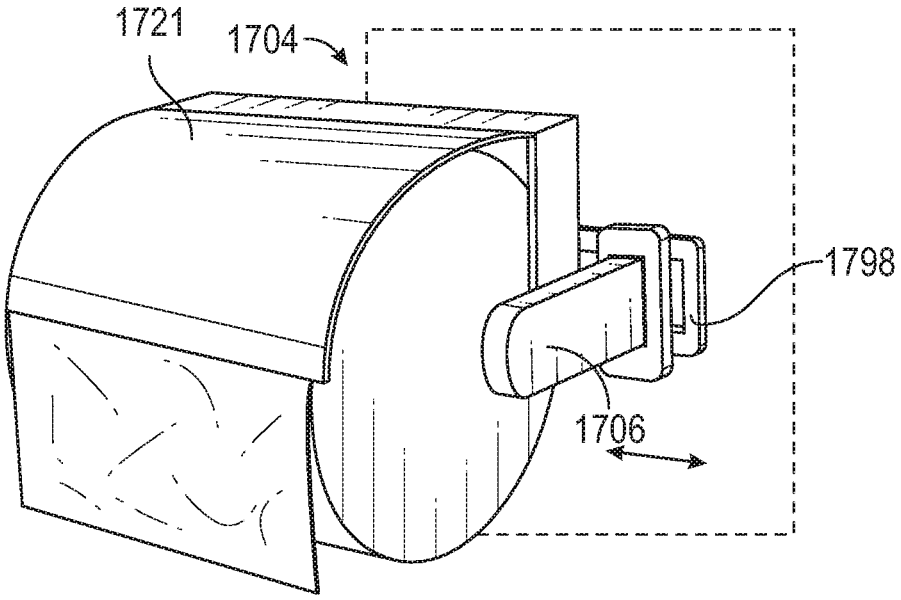
FIG. 38 is a perspective view of another embodiment of a cover assembly.

FIGS. 36-38 illustrate another cover assembly 1704, which is designed to mount to independent arms 1706 of a pair of roll holder arms, e.g., of a standard, non-recessed tissue roll holder. The cover assembly 1704 includes a cover 1721 which is connect along one edge to a frame 1770. The cover assembly 1704 also includes a pair of brackets 1798 extend from the sides of the frame 1770 and which each include a large opening to accommodate different spacings of roll holder arms. The bracket 1798 is configured to slide behind the base of the roll holder arm 1706, similarly to the way in which the arms of the bracket 1410 in cover assembly 1404 are configured to slide behind the side edges of the frame of the tissue roll holder.

Figure 39:
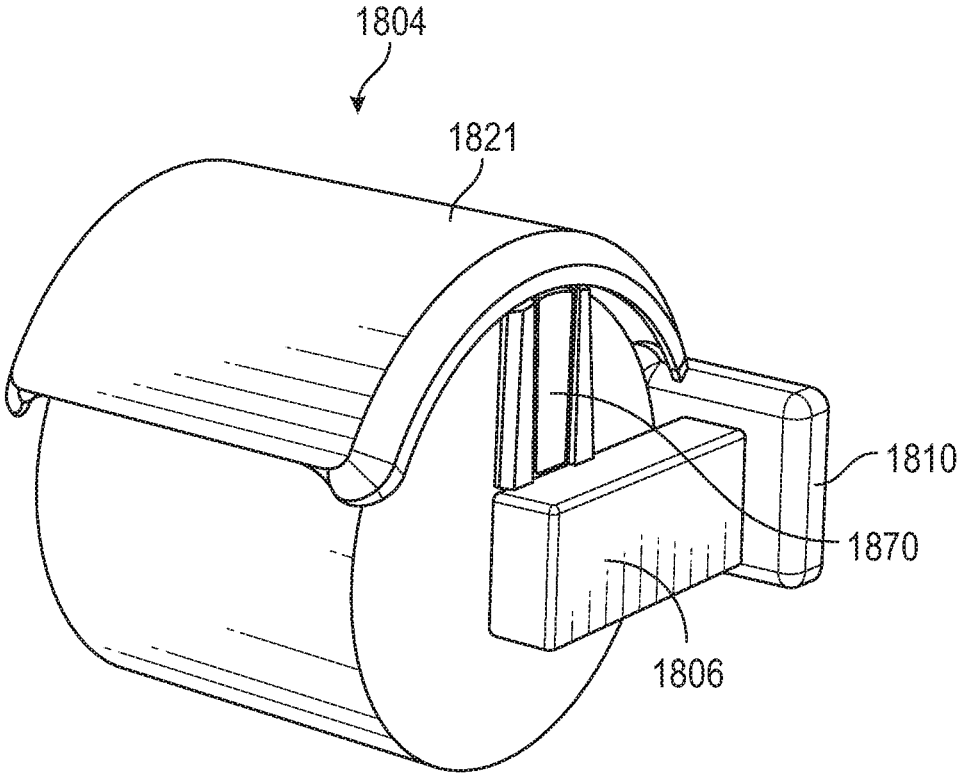
FIG. 39 is a perspective view of still another embodiment of a cover assembly.

FIG. 39 shows another embodiment of a cover assembly 1804. The cover assembly 1804 is configured to slide over a variety of roll holding arms of a conventional tissue roll holder 1810. The cover assembly 1804 includes a sleeve 1806 and a cover 1821, which is connected to the sleeve 1806 by a support arm 1870. The sleeve 1806 has an open end for receiving the roll holder arm. The sleeve 1806 may be oversized to accommodate variations in the sizes of the roll holder arms, and the sleeve 1806 may include a screw/pad or other fastening system (not shown) to secure the sleeve 1806 to the roll holder arm. In addition, the support arm 1870 may be hingedly connected to the cover 1821 to accommodate variations in spacing between the roll holder arms.

Figure 40:
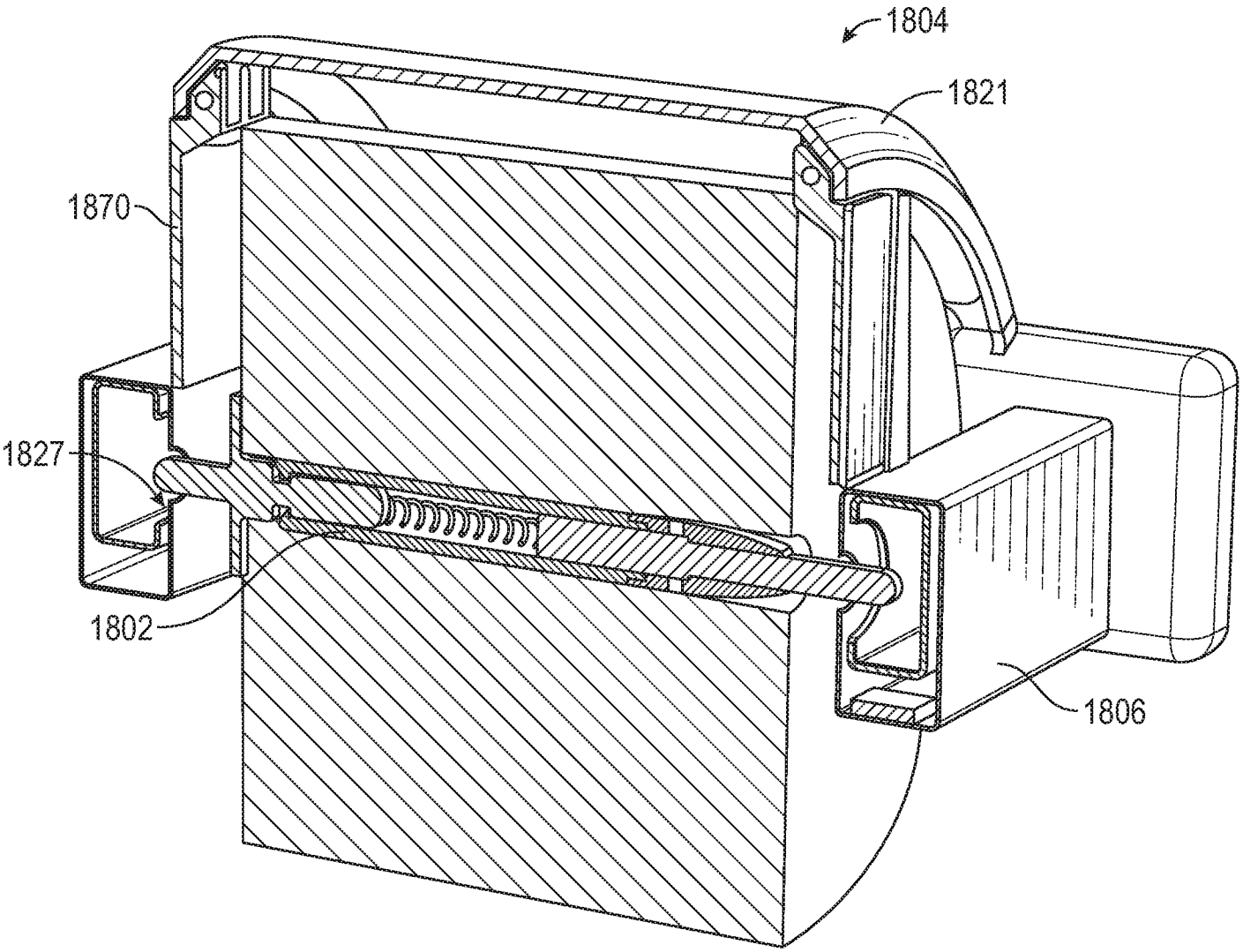
FIG. 40 is a perspective, cross-sectional view of the cover assembly shown in FIG. 39.

FIG. 40 shows cover assembly 1804 in an installed configuration. The sleeves 1806 include apertures 1827 for receiving the ends of the spindle 1802. As shown in FIG. 40, the roll holder arm has a large recess for receiving a spindle, and the aperture 1827 of the sleeve 1806 is smaller than, and aligned with, the large recess of the roll holder arm, potentially providing a more uniform, stable spindle position, possibly obviating the need for a spindle adaptor as described above.

Figure 41:
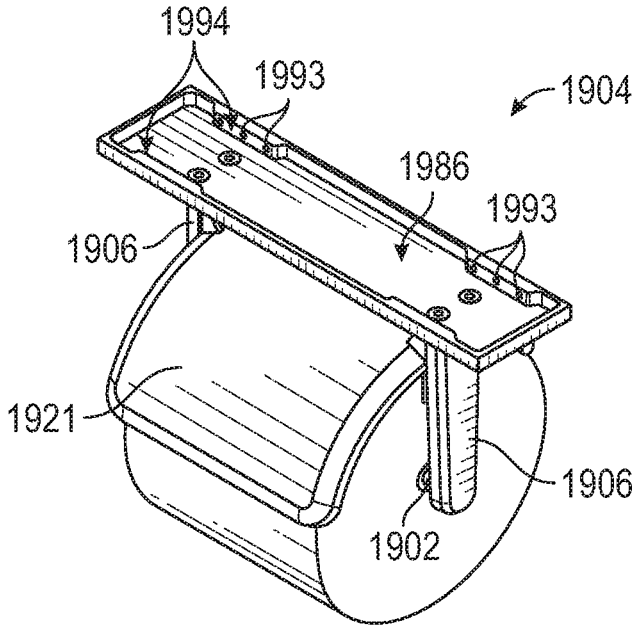
FIG. 41 is a perspective view of yet another embodiment of a cover assembly.

FIG. 41 shows another dispenser assembly with a cover assembly 1904 and a spindle 1902. This dispenser assembly entirely replaces a conventional dispenser except for the mounting brackets remaining once the majority of the roll holding assembly is removed. The dispenser assembly includes two roll holder arms 1906 and a cover 1921 connected to the roll holder arms at opposed sides of the cover. The dispenser assembly also includes an elongated back plate 1986 from which the two roll holder arms extend and which can be mounted to a surface using brackets and fasteners, such as those known in the art.

The elongated back plate 1986 includes mounting bracket interface features 1994. The interface features 1994 include an interface geometry configured to replicate the interface geometry of interface features of conventional roll holder arms for mounting to conventional, installed mounting brackets, to thereby enable to the dispenser assembly to be retrofitted to the conventional, installed mounting brackets. This interface geometry of the interface features 1994 is extended parallel to the spindle 1902 between the two roll holder arms 1906, so as to accommodate variation in spacings likely to be encountered in various retrofitting installations of the dispenser assembly. In addition, the back plate 1986 includes a plurality of holes 1993 in the backside for receiving set screws or other fasteners, regardless of the spacing of the mounting brackets (e.g., within ±½ inch to 1 inch).

Figure 42:
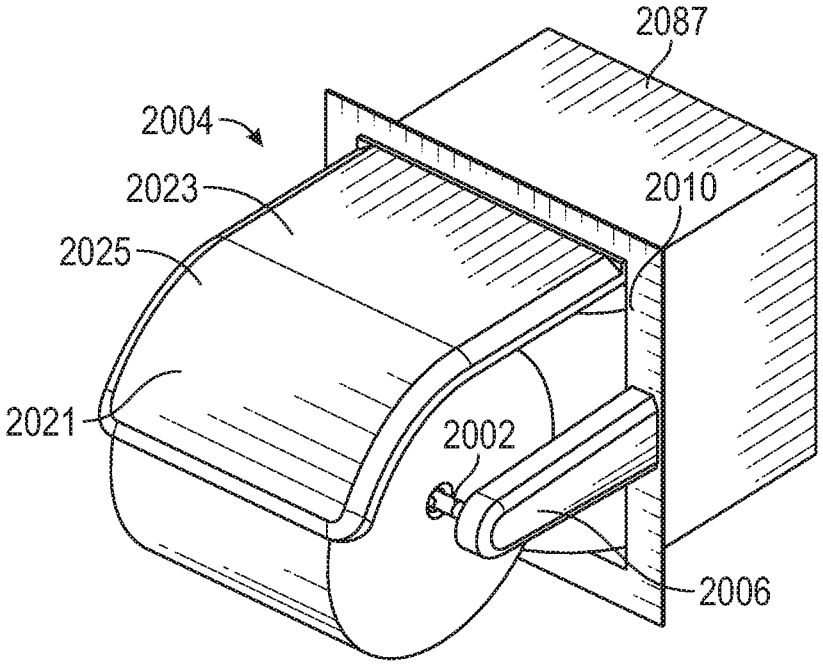
FIG. 42 is a perspective view of a further embodiment of a cover assembly.

FIG. 42 shows another embodiment of a dispenser assembly 2004, shown with a conventional recessed box 2087. The assembly includes a cover 2021, roll holder arms 2006, a spindle 2002, and a frame 2010 to which one edge of the over is fixed and to which the roll holder arms 2006 are fixed. The cover 2021 may include two parts: a first portion 2023 connected in a fixed position to the frame 2010, and a second portion 2025 connected along one edge to the first portion. The first portion as shown is substantially planar, and the second portion as shown is arcuate in shape. The first and second portions and may be connected to one another with their positions relative to one another being fixed, or the two portions may be hingedly connected.

Although specific embodiments of the disclosure have been described, numerous other modifications and alternative embodiments are within the scope of the disclosure.

We claim:

1. A spindle for use with a coreless sheet product roll, the spindle comprising:

a hollow cylindrical body comprising a first end which has an opening bounded by an inward facing ledge, the hollow cylindrical body comprising an internal wall which separates a first hollow space open toward the first end from a second hollow space open toward an opposing second end;

a rod which extends partially out of the first end of the hollow cylindrical body and which comprises a radial ledge; and a spring disposed within the hollow cylindrical body and having one end in biasing contact with an end of the rod disposed within the hollow cylindrical body, wherein the rod is permitted to translate within the hollow cylindrical body but cannot fall out of the first end of the hollow cylindrical body due to interference between the inward facing ledge of the hollow cylindrical body and the radial ledge of the rod, and wherein the spindle is dimensioned to be fit into and engage with a central opening of the coreless sheet product roll, and wherein the second end comprises an integral disk and opening which is closed off by an end cap secured to the second end of the hollow cylindrical body, the end cap comprising an end piece for mounting to a roller arm.

2. The spindle of claim 1, wherein the end piece has a square cross-sectional shape as viewed in an axial direction of the spindle.

3. The spindle of claim 1, wherein the hollow cylindrical body and the rod are formed of metal.

4. The spindle of claim 1, wherein the second hollow space is configured to receive the end piece for mounting the spindle.

5. The spindle of claim 1, wherein at least two fins extend outwardly from the hollow cylindrical body and wherein the at least two fins extend axially along a length of the hollow cylindrical body.

6. A cover assembly for a roll of sheet product, the cover assembly comprising:

a mounting member for securing the cover assembly to a surface;

a pair of arms spaced for securing a spindle and a roll of sheet product therebetween;

a cover connected to the mounting member and disposed over a space between the pair of arms, wherein at least one of the arms comprises (i) a bearing for receiving a mounting end of the spindle and (ii) an adjustable clamp disposed about and in contact with the bearing.

7. The cover assembly of claim 6, wherein the bearing and the adjustable clamp are concealed in a recess within the at least one arm.

8. The cover assembly of claim 6, wherein the bearing comprises a non-cylindrical recess configured to receive a non-cylindrical mounting end, such that the mounting end is rotationally fixed with the bearing.

9. A spindle for use with a coreless sheet product roll, the spindle comprising:

a hollow cylindrical body having a first end;

a ring defining an interior surface wherein the interior surface comprises an inward facing ledge;

a rod which extends partially out of the first end of the hollow cylindrical body and which comprises a radial ledge; and a spring disposed within the hollow cylindrical body and having one end in biasing contact with an end of the rod disposed within the hollow cylindrical body, wherein the ring is attached to the first end of the hollow cylindrical body and wherein the rod is permitted to translate within the hollow cylindrical body but cannot fall out of the first end of the hollow cylindrical body due to interference between the inward facing ledge of the ring and the radial ledge of the rod, wherein the hollow cylindrical body has at least two fins extending directly and outwardly therefrom, the at least two fins extending axially along a length of the hollow cylindrical body, and wherein the hollow cylindrical body has a second end opposed to the first end and the second end comprises an integral disk and opening which is closed off by an end cap secured to the second end of the hollow cylindrical body, the end cap comprising an end piece for mounting to a roller arm.

10. The spindle of claim 9, wherein the end piece has a non-cylindrical cross-sectional shape as viewed in an axial direction of the spindle.

11. The spindle of claim 9, wherein the hollow cylindrical body comprises an internal wall which isolates a first hollow space open toward the first end from a second hollow space open toward the second end, wherein the second hollow space is configured to receive the end piece for mounting the spindle.

12. A spindle for use with a coreless sheet product roll, the spindle comprising:

a hollow cylindrical body having a first end;

a ring defining an interior surface, wherein the interior surface comprises an inward facing ledge;

a rod which extends partially out of the first end of the hollow cylindrical body and which comprises a radial ledge; and a spring disposed within the hollow cylindrical body and having one end in biasing contact with an end of the rod disposed within the hollow cylindrical body, wherein the rod is permitted to translate within the hollow cylindrical body but cannot fall out of the first end of the hollow cylindrical body due to interference between the inward facing ledge of the ring and the radial ledge of the rod, wherein the ring has a first end and an opposed second end, the first end of the ring being attached to the first end of the hollow cylindrical body, the ring further comprising an outer surface which tapers toward the second end of the ring in a region between the inward facing ledge and the second end of the ring, and wherein the hollow cylindrical body comprises an internal wall which separates a first hollow space open toward the first end of the hollow cylindrical body from a second hollow space open toward an opposing second end of the hollow cylindrical body.

13. The spindle of claim 12, wherein the hollow cylindrical body has at least two fins extending directly and outwardly therefrom, the at least two fins extending axially along a length of the hollow cylindrical body.

14. The spindle of claim 12, wherein the rod has a spherical shaped end opposed to the end of the rod in biasing contact with the spring.

* * * * *